US006257690B1

(12) United States Patent
Holstun

(10) Patent No.: US 6,257,690 B1
(45) Date of Patent: Jul. 10, 2001

(54) INK EJECTION ELEMENT FIRING ORDER TO MINIMIZE HORIZONTAL BANDING AND THE JAGGEDNESS OF VERTICAL LINES

(75) Inventor: Clayton L. Holstun, San Marcos, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/240,177

(22) Filed: Jan. 30, 1999

Related U.S. Application Data

(63) Continuation-in-part of application No. 09/227,500, filed on Jan. 7, 1999, and a continuation-in-part of application No. 09/183,949, filed on Oct. 31, 1998.

(51) Int. Cl.[7] ..... B41J 29/38

(52) U.S. Cl. ..... 347/12; 347/43; 347/76

(58) Field of Search ..... 347/12, 15, 43, 347/55, 254, 65, 76, 78, 79, 145, 188, 232, 240; 358/1.17

(56) References Cited

U.S. PATENT DOCUMENTS

| | | | | |
|---|---|---|---|---|
| 3,813,676 | * | 5/1974 | Wolfe | 347/76 |
| 3,828,354 | * | 8/1974 | Hilton | 347/79 |
| 4,215,355 | * | 7/1980 | Moore | 347/145 |
| 4,271,417 | * | 6/1981 | Blumenthal | 347/145 |
| 4,395,716 | * | 7/1983 | Crean et al. | 347/76 |
| 4,435,720 | * | 3/1984 | Horike et al. | 347/78 |
| 4,855,752 | * | 8/1989 | Bergstedt | 347/43 |
| 5,134,495 | * | 7/1992 | Frazier et al. | 347/254 |
| 5,430,472 | * | 7/1995 | Curry et al. | 347/232 |
| 5,512,923 | * | 4/1996 | Bauman | 347/15 |
| 5,588,095 | * | 12/1996 | Dennis et al. | 358/1.17 |
| 5,648,805 | | 7/1997 | Keefe et al. . | |
| 5,684,620 | * | 11/1997 | Schoen | 347/240 |
| 5,706,098 | * | 1/1998 | Clark et al. | 347/188 |
| 5,874,974 | | 2/1999 | Courian et al. | 347/65 |
| 6,155,670 | * | 12/2000 | Weber et al. | 347/43 |

FOREIGN PATENT DOCUMENTS

| | | |
|---|---|---|
| 0816102 | 1/1999 | (EP) . |
| 10-202851 | 8/1998 | (JP) . |

OTHER PUBLICATIONS

EP Search Report EP 99 30 8597.

* cited by examiner

*Primary Examiner*—Eugene Eickholt
(74) *Attorney, Agent, or Firm*—Dennis G. Stenstrom

(57) ABSTRACT

A printer for printing rows and columns of ink dots onto a medium is disclosed with the printer comprising a scanning carriage for scanning across the medium;

a printhead mounted on the scanning carriage, the printhead including a plurality of primitives, each primitive having a plurality of ink ejection elements for ejecting ink therefrom, each primitive having a primitive size defined by the number of ink ejection elements within the primitive;

a primitive select circuit electrically coupled to the ink ejection elements of the primitives and including a plurality of primitives lines for energizing the ink ejection elements;

an address select circuit electrically coupled to the ink ejection elements of the primitives and including a plurality of address lines for addressing the ink ejection elements, so that ink ejection elements located at a particular physical position within their respective primitives have the same address line; and an address line sequencer for setting a firing order in which the address lines are energized in a non-sequential firing order that reduces horizontal banding and vertical jaggedness.

20 Claims, 20 Drawing Sheets

FIG. 6

| TOP LEFT | TOP RIGHT |
|---|---|
| R2<br>PRIMITIVE 2<br>R16 | R1<br>PRIMITIVE 1<br>R15 |
| R18<br>PRIMITIVE 4<br>R32 | R17<br>PRIMITIVE 3<br>R31 |
| R34<br>PRIMITIVE 6<br>R48 | R33<br>PRIMITIVE 5<br>R47 |
| R50<br>PRIMITIVE 8<br>R64 | 49<br>PRIMITIVE 7<br>63 |
| R66<br>PRIMITIVE 10<br>R80 | R65<br>PRIMITIVE 9<br>R79 |
| R82<br>PRIMITIVE 12<br>R96 | R81<br>PRIMITIVE 11<br>R95 |
| R98<br>PRIMITIVE 14<br>R112 | R97<br>PRIMITIVE 13<br>R111 |
| R114<br>PRIMITIVE 16<br>R128 | R113<br>PRIMITIVE 15<br>R127 |
| R130<br>PRIMITIVE 18<br>R144 | R129<br>PRIMITIVE 17<br>R143 |
| R146<br>PRIMITIVE 20<br>R160 | R145<br>PRIMITIVE 19<br>R159 |
| R162<br>PRIMITIVE 22<br>R176 | R161<br>PRIMITIVE 21<br>R175 |
| R178<br>PRIMITIVE 24<br>R192 | R177<br>PRIMITIVE 23<br>R191 |
| BOTTOM LEFT | BOTTOM RIGHT |

| NOZZLE NUMBER | PRIMITIVE NUMBER | ADDRESS LINE |
|---|---|---|
| 1 | 1 | 1 |
| 2 | 2 | 1 |
| 3 | 1 | 2 |
| 4 | 2 | 2 |
| 5 | 1 | 3 |
| 6 | 2 | 3 |
| 7 | 1 | 4 |
| 8 | 2 | 4 |
| 9 | 1 | 5 |
| 10 | 2 | 5 |
| 11 | 1 | 6 |
| 12 | 2 | 6 |
| 13 | 1 | 7 |
| 14 | 2 | 7 |
| 15 | 1 | 8 |
| 16 | 2 | 8 |
| 17 | 3 | 1 |
| 18 | 4 | 1 |
| 19 | 3 | 2 |
| 20 | 4 | 2 |
| 21 | 3 | 3 |
| 22 | 4 | 3 |
| 23 | 3 | 4 |
| 24 | 4 | 4 |
| 25 | 3 | 5 |
| 26 | 4 | 5 |
| 27 | 3 | 6 |
| 28 | 4 | 6 |
| 29 | 3 | 7 |
| 30 | 4 | 7 |
| 31 | 3 | 8 |
| 32 | 4 | 8 |

| NOZZLE NUMBER | PRIMITIVE NUMBER | ADDRESS LINE |
|---|---|---|
| 33 | 5 | 1 |
| 34 | 6 | 1 |
| 35 | 5 | 2 |
| 36 | 6 | 2 |
| 37 | 5 | 3 |
| 38 | 6 | 3 |
| 39 | 5 | 4 |
| 40 | 6 | 4 |
| 41 | 5 | 5 |
| 42 | 6 | 5 |
| 43 | 5 | 6 |
| 44 | 6 | 6 |
| 45 | 5 | 7 |
| 46 | 6 | 7 |
| 47 | 5 | 8 |
| 48 | 6 | 8 |
| 49 | 7 | 1 |
| 50 | 8 | 1 |
| 51 | 7 | 2 |
| 52 | 8 | 2 |
| 53 | 7 | 3 |
| 54 | 8 | 3 |
| 55 | 7 | 4 |
| 56 | 8 | 4 |
| 57 | 7 | 5 |
| 58 | 8 | 5 |
| 59 | 7 | 6 |
| 60 | 8 | 6 |
| 61 | 7 | 7 |
| 62 | 8 | 7 |
| 63 | 7 | 8 |
| 64 | 8 | 8 |

FIG.10A

| NOZZLE NUMBER | PRIMITIVE NUMBER | ADDRESS LINE |
|---|---|---|
| 65 | 9 | 1 |
| 66 | 10 | 1 |
| 67 | 9 | 2 |
| 68 | 10 | 2 |
| 69 | 9 | 3 |
| 70 | 10 | 3 |
| 71 | 9 | 4 |
| 72 | 10 | 4 |
| 73 | 9 | 5 |
| 74 | 10 | 5 |
| 75 | 9 | 6 |
| 76 | 10 | 6 |
| 77 | 9 | 7 |
| 78 | 10 | 7 |
| 79 | 9 | 8 |
| 80 | 10 | 8 |
| 81 | 11 | 1 |
| 82 | 12 | 1 |
| 83 | 11 | 2 |
| 84 | 12 | 2 |
| 85 | 11 | 3 |
| 86 | 12 | 3 |
| 87 | 11 | 4 |
| 88 | 12 | 4 |
| 89 | 11 | 5 |
| 90 | 12 | 5 |
| 91 | 11 | 6 |
| 92 | 12 | 6 |
| 93 | 11 | 7 |
| 94 | 12 | 7 |
| 95 | 11 | 8 |
| 96 | 12 | 8 |

| NOZZLE NUMBER | PRIMITIVE NUMBER | ADDRESS LINE |
|---|---|---|
| 97 | 13 | 1 |
| 98 | 14 | 1 |
| 99 | 13 | 2 |
| 100 | 14 | 2 |
| 101 | 13 | 3 |
| 102 | 14 | 3 |
| 103 | 13 | 4 |
| 104 | 14 | 4 |
| 105 | 13 | 5 |
| 106 | 14 | 5 |
| 107 | 13 | 6 |
| 108 | 14 | 6 |
| 109 | 13 | 7 |
| 110 | 14 | 7 |
| 111 | 13 | 8 |
| 112 | 14 | 8 |
| 113 | 15 | 1 |
| 114 | 16 | 1 |
| 115 | 15 | 2 |
| 116 | 16 | 2 |
| 117 | 15 | 3 |
| 118 | 16 | 3 |
| 119 | 15 | 4 |
| 120 | 16 | 4 |
| 121 | 15 | 5 |
| 122 | 16 | 5 |
| 123 | 15 | 6 |
| 124 | 16 | 6 |
| 125 | 15 | 7 |
| 126 | 16 | 7 |
| 127 | 15 | 8 |
| 128 | 16 | 8 |

FIG.10B

| NOZZLE NUMBER | PRIMITIVE NUMBER | ADDRESS LINE |
|---|---|---|
| 129 | 17 | 1 |
| 130 | 18 | 1 |
| 131 | 17 | 2 |
| 132 | 18 | 2 |
| 133 | 17 | 3 |
| 134 | 18 | 3 |
| 135 | 17 | 4 |
| 136 | 18 | 4 |
| 137 | 17 | 5 |
| 138 | 18 | 5 |
| 139 | 17 | 6 |
| 140 | 18 | 6 |
| 141 | 17 | 7 |
| 142 | 18 | 7 |
| 143 | 17 | 8 |
| 144 | 18 | 8 |
| 145 | 19 | 1 |
| 146 | 20 | 1 |
| 147 | 19 | 2 |
| 148 | 20 | 2 |
| 149 | 19 | 3 |
| 150 | 20 | 3 |
| 151 | 19 | 4 |
| 152 | 20 | 4 |
| 153 | 19 | 5 |
| 154 | 20 | 5 |
| 155 | 19 | 6 |
| 156 | 20 | 6 |
| 157 | 19 | 7 |
| 158 | 20 | 7 |
| 159 | 19 | 8 |
| 160 | 20 | 8 |

| NOZZLE NUMBER | PRIMITIVE NUMBER | ADDRESS LINE |
|---|---|---|
| 161 | 21 | 1 |
| 162 | 22 | 1 |
| 163 | 21 | 2 |
| 164 | 22 | 2 |
| 165 | 21 | 3 |
| 166 | 22 | 3 |
| 167 | 21 | 4 |
| 168 | 22 | 4 |
| 169 | 21 | 5 |
| 170 | 22 | 5 |
| 171 | 21 | 6 |
| 172 | 22 | 6 |
| 173 | 21 | 7 |
| 174 | 22 | 7 |
| 175 | 21 | 8 |
| 176 | 22 | 8 |
| 177 | 23 | 1 |
| 178 | 24 | 1 |
| 179 | 23 | 2 |
| 180 | 24 | 2 |
| 181 | 23 | 3 |
| 182 | 24 | 3 |
| 183 | 23 | 4 |
| 184 | 24 | 4 |
| 185 | 23 | 5 |
| 186 | 24 | 5 |
| 187 | 23 | 6 |
| 188 | 24 | 6 |
| 189 | 23 | 7 |
| 190 | 24 | 7 |
| 191 | 23 | 8 |
| 192 | 24 | 8 |

FIG.10C

INK EJECTION ELEMENT FIRING ORDER TO MINIMIZE HORIZONTAL BANDING AND THE JAGGEDNESS OF VERTICAL LINES

CROSS-REFERENCE TO RELATED APPLICATIONS

This application is a continuation-in-part both of U.S. patent application Ser. No. 09/227,500, filed Jan. 7, 1999, entitled "Printer Having Media Advance Coordinated With Primitive Size" and U.S. patent application Ser. No. 09/183,949, filed Oct. 31, 1998, entitled "Varying the Operating Energy Applied to an Inkjet Print Cartridge Based upon the Operating Conditions." This application is also related to U.S. patent application Ser. No. 09/071,138, filed Apr. 30, 1998, entitled "Energy Control Method for an Inkjet Print Cartridge;" U.S. patent application Ser. No. 08/958,951, filed Oct. 28, 1997, entitled "Thermal Ink Jet Print Head and Printer Energy Control Apparatus and Method now U.S. Pat. No. 6,183,056;" U.S. patent application Ser. No. 09/016,478, filed Jan. 30, 1998, entitled "Hybrid Multi-Drop/Multi-Pass Printing System now U.S. Pat. No. 6,193,347;" U.S. patent application Ser. No. 08/962,031, filed Oct. 31, 1997, entitled "Ink Delivery System for High Speed Printing;" U.S. patent application, Ser. No. 08/608,376, filed Feb. 28, 1996, entitled "Reliable High Performance Drop Generator For An Inkjet Printhead now U.S. Pat. No. 5,874,947;" and U.S. Pat. No. 5,648,805, entitled "Inkjet Printhead Architecture for High Speed and High Resolution Printing;" The foregoing commonly assigned patent applications are herein incorporated by reference.

FIELD OF THE INVENTION

This invention relates to Inkjet printers and more particularly to a printhead wherein the firing order of the ink ejection elements is used to minimize horizontal banding and the jaggedness of vertical lines.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of Output Hardcopy Devices (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994)], incorporated herein by reference. Inkjet hardcopy devices produce high quality print, are compact and portable, and print quickly and quietly because only ink strikes the media.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or "pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). The printhead has an array of ink ejection elements formed in the substrate. The printhead incorporates an array of ink ejection chambers defined by a barrier layer formed on the substrate. Within each ink ejection chamber is the ink ejection element formed in the substrate. Precisely formed orifices or nozzles formed in a nozzle member is attached to a printhead. Each ink ejection chamber and ink ejection element is located opposite the nozzle so that ink can collect between it and the nozzle. The ink ejection chambers receive liquid ink from an ink reservoir. The ejection of ink droplets is typically under the control of a microprocessor, the signals of which are conveyed by electrical traces to the ink ejection elements. When electric printing pulses activate the inkjet ink ejection element, a droplet of ink is ejected from the printhead. Properly sequencing the operation of each ink ejection element causes characters or images to be printed upon the media as the printhead moves past the media.

The ink cartridge containing the printhead is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After all such completed movements, the medium is advanced forward and the ink cartridge begins the next swath. By proper selection and timing of the signals, the desired print is obtained on the medium.

One problem with conventional inkjet printers is droplet or dot displacement. This problem is most apparent when printing a vertical line. Typical print cartridges cycle through their firing order only once per pixel. Since print cartridges continuously proceed through their firing order as the scanning carriage moves across the medium, ink droplets ejected from nozzles at the beginning of the firing order are deposited at their desired location, while those ejected at the end of the firing order are displaced from their desired position by a distance approximately equal to the pixel width. For a 600 dpi printer this error distance is 42 microns. Thus, a resulting vertical line will appear jagged rather than straight.

One solution to the dot displacement problem is to stagger the physical position of the nozzles and their respective ink ejection chambers on the substrate of the printhead. Although effective at solving the dot displacement problem, this approach is relatively complex. The ink flow distance from the edge of the substrate to an ink ejection chamber varies depending on the location of the particular ink ejection chamber. Ink ejection chambers located closer to the edge refill faster than those further away. This creates differences in both the volume and velocity of ejected ink droplets.

Another solution to the dot displacement problem involves rotating the entire printhead. This approach, however, employs a more complex print cartridge and scanning carriage in order to create the rotation. In addition, this print cartridge is more difficult to code and requires additional memory, since data for many different columns must be buffered up simultaneously.

Still another approach is minimizing dot displacement error by increasing the number of times per pixel that a print cartridge with non-staggered nozzles cycles through its firing order. These high firing frequency, multi-drop per pixel print cartridges can be designed with no ink ejection element stagger and no rotation of the printhead, because the total positional error produced is normally small, i.e., a fraction of a column width. This design gives the advantage of having the fluidic responses of the firing chambers all the same, which results in faster print cartridges with less overshoot and puddling. However, even the small positional errors can become visible defects when they are repeated in a regular pattern.

Therefore, there is a need for a simple, high speed printer that reduces dot displacement error without ejection element stagger or rotation of the printhead.

SUMMARY OF THE INVENTION

The present invention deals with picking a firing order for print cartridge designs having non-staggered ink ejection elements which minimizes horizontal banding and the jaggedness of vertical lines. The non-staggered printhead design achieves high ink ejection rates by having nozzles and ink ejection elements at a constant minimal distance from the edge of the printhead.

In accordance with one embodiment of the present invention, a printer for printing rows of ink dots onto a medium is provided. The printer includes a scanning carriage, a printhead. The printhead is mounted on the scanning carriage which scans across the medium. The printhead includes a plurality of primitives, each of which has a plurality of non-staggered nozzles for ejecting ink and a plurality of ink ejection elements. Each ink ejection element is associated with a respective nozzle of a respective primitive. Each primitive has a primitive size defined by the number of nozzles in the primitive. The printer further includes an address select circuit electrically coupled to the ink ejection elements of the printhead and having a plurality of address lines. The ink ejection elements of the different primitives are organized such that those elements located at the same position within their respective primitives have the same address line. An address line sequencer for sets the order in which the address lines are energized, so that the address lines are energized in a order which reduces horizontal banding and vertical jaggedness.

In accordance with a second embodiment of the invention, a method of printing rows of ink dots onto a medium includes scanning a printhead across the medium to print rows of ink dots. The printhead includes a plurality of primitives, nonstaggered nozzles and ink ejection elements, similar to that described with respect to the first embodiment. Sequencing the address lines in a non-sequential order while scanning the printhead across the medium; wherein the sequencing of the address lines thereby reduces horizontal banding and vertical line jaggedness.

BRIEF DESCRIPTION OF THE DRAWINGS

FIG. 6 is a top plan schematic view of one arrangement of primitives and the associated ink ejection elements and nozzles on a printhead, with the long axis of the array perpendicular to the scan direction of the printhead.

FIGS. 10A–10C show the primitive select and address select lines for each of the 192 ink ejection elements of the printhead of FIGS. 6 and 7.

DETAILED DESCRIPTION OF THE PREFERRED EMBODIMENTS

Figure 1:
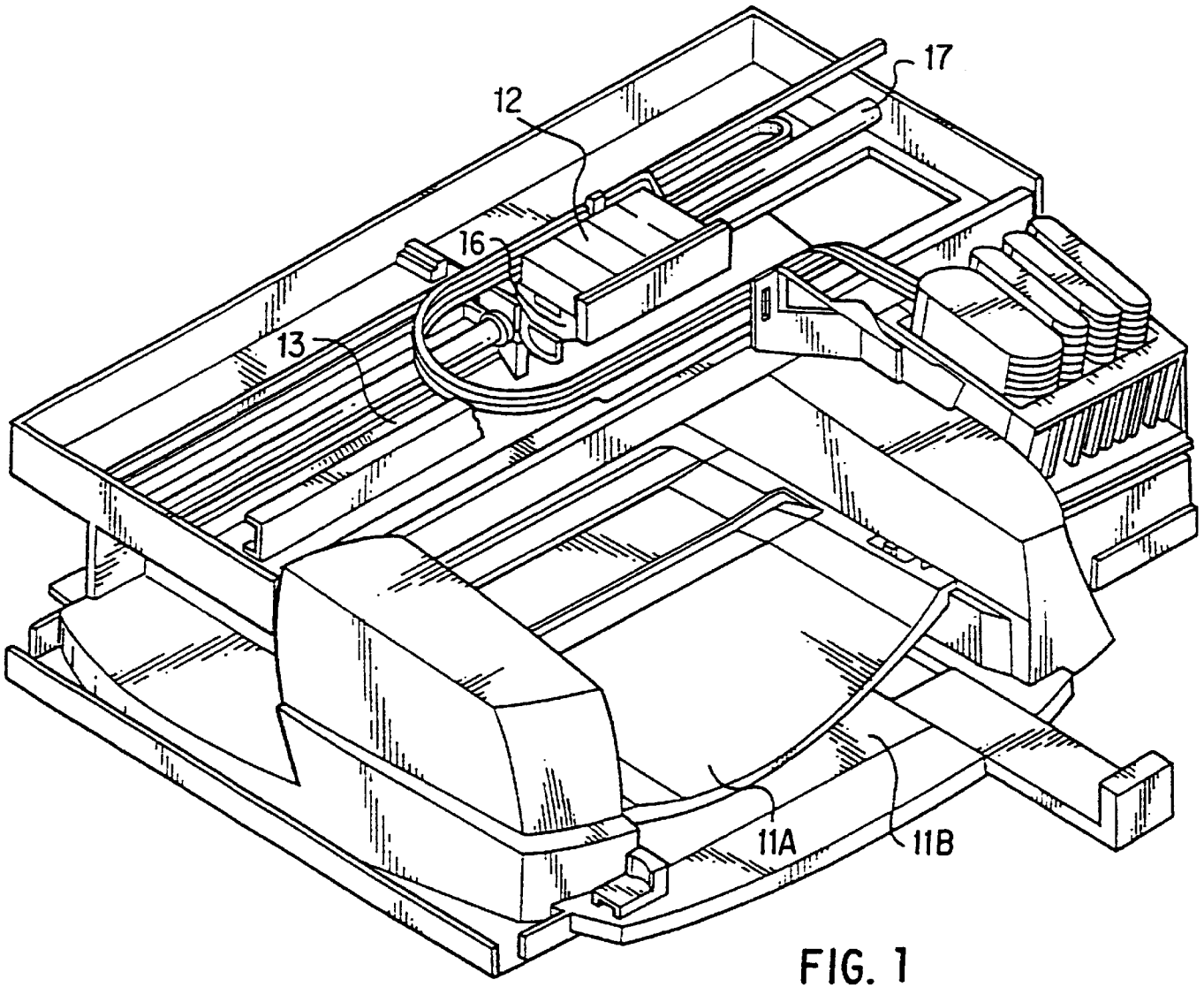
FIG. 1 is a perspective view of one embodiment of an inkiet printer incorporating the present invention.

FIG. 1 is a perspective view of one embodiment of an inkjet printer 10 suitable for utilizing the present invention, with its cover removed. Generally, printer 10 includes a tray 11A for holding virgin media. When a printing operation is initiated, a sheet of media from input tray 11A is fed into printer 10 using a sheet feeder, then brought around in a U direction to now travel in the opposite direction toward output tray 11B. The sheet is stopped in a print zone 13, and a scanning carriage 16, supporting one or more print cartridges 12, is then passed across a print zone on the sheet for printing a swath of ink thereon. The printing may occur while the carriage is passing in either directional. This is referred to as bi-directional printing. After a single pass or multiple passes, the sheet is then incrementally shifted an amount based on the printmode being used, using a conventional stepper motor and feed rollers to a next position withi the print zone 13, and carriage 16 again passes across the sheet for printing a next swath of ink. When the printing on the sheet is complete, the sheet is forwarded to a position above tray 13, held in that position to ensure the ink is dry and then released.

The carriage 16 scanning mechanism may be conventional and generally includes a slide rod 17, along which carriage 16 slides, a flexible cable (not shown in FIG. 1) for transmitting electrical signals from the printer's controller to the carriage 16 and then to electrodes on the carriage 16 which engage electrical contacts 86 on print cartridges 12 when they are installed in the printer. A motor (not shown), connected to carriage 16 using a conventional drive belt and pulley arrangement, may be used for transporting carriage 16 across print zone 14.

Figure 2:
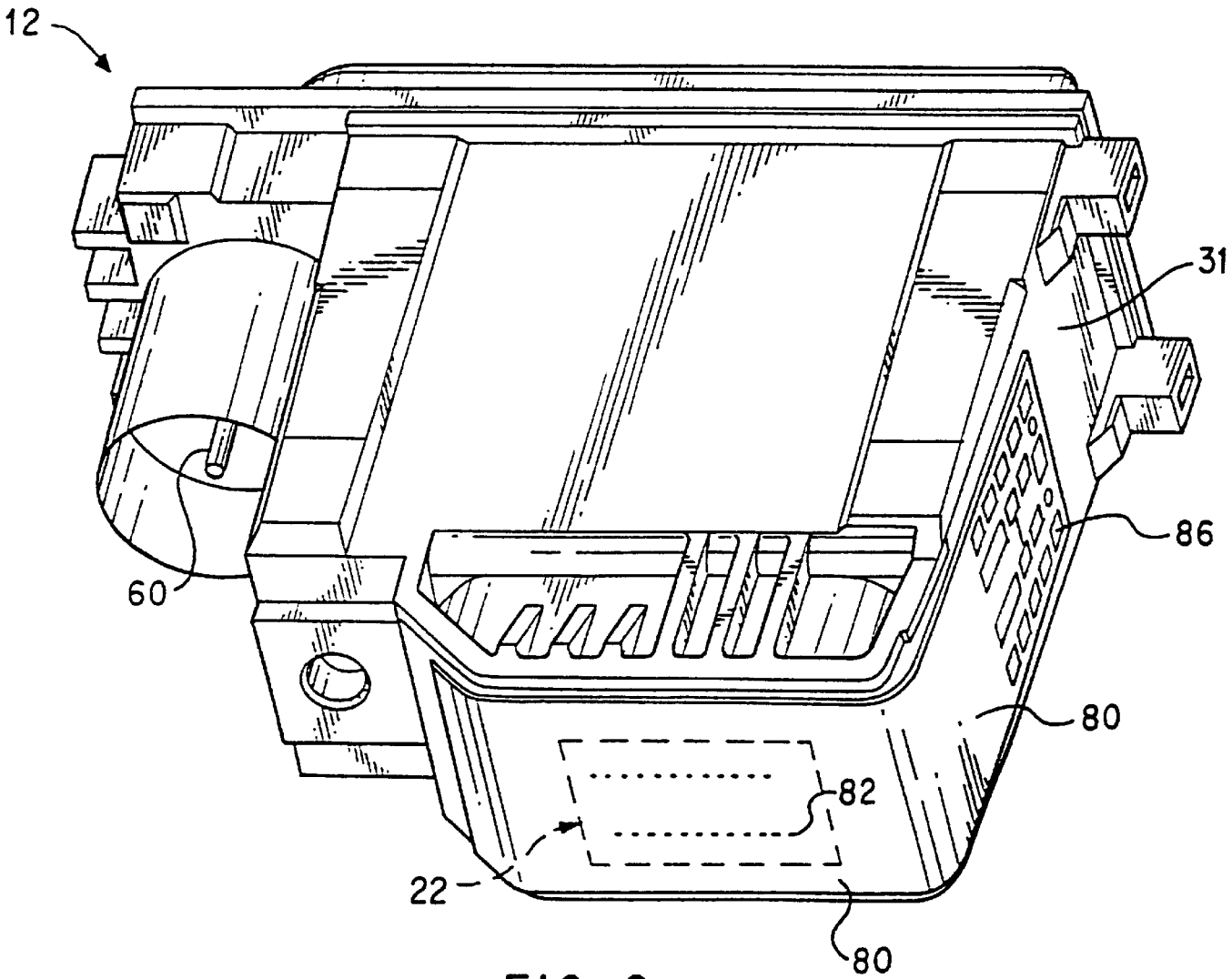
FIG. 2 is a bottom perspective view of a single print cartridge.

FIG. 2 illustrates a print cartridge 12 having a printhead assembly 22 attached which includes a flexible tape 80 containing nozzles 82 and electrical contact pads 86. The contact pads 86 align with and electrically contact electrodes (not shown) on carriage 16. The print cartridge also includes a memory device 31 for storing calibration information determined on the manufacturing line or subsequently. Values typically include operating voltage, operating energy, turn-on energy, print cartridge resistances including common parasitic resistances and drop volumes. This information can the be read and stored by the printer when the print cartridge is installed in the printer.

Figure 3:
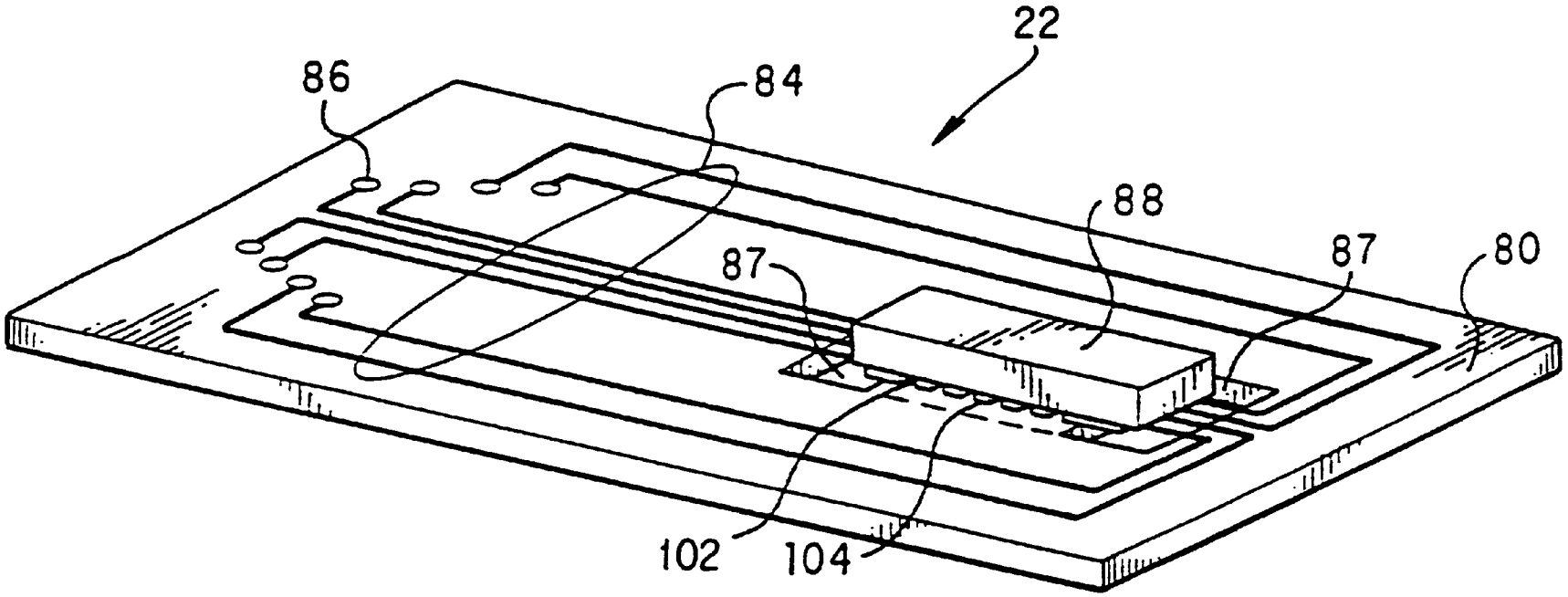
FIG. 3 is a highly schematic perspective view of the back side of a simplified printhead assembly.

FIG. 3 illustrates the back surface of printhead 22. Mounted on the back surface of flexible circuit 80 is a silicon substrate 88. Substrate 88 includes a plurality of individually energizable ink ejection elements, each of which is located generally behind a single orifice or nozzle 82. Substrate 88 includes a barrier layer 104 with ink channels 106 formed therein. Ink channels 106 receive ink from an ink reservoir. The back surface of flexible circuit 80 includes conductive traces 84 formed thereon by a conventional lithographic etching and/or plating process. These conductive traces 84 terminate in large contact pads 86 on a front surface of flexible circuit 80. The other ends of conductors 84 are bonded to electrodes 87 on substrate 88. Contact pads 86 contact printer electrodes when print cartridge 12 is installed in printer 10 to transfer externally generated energization signals to printhead assembly 22. Nozzles 82 and conductive traces 84 may be of any size, number, and pattern, and the various figures are designed to show simply the features of the invention. The relative dimensions of the various features have been greatly adjusted for the sake of clarity.

Figure 4:
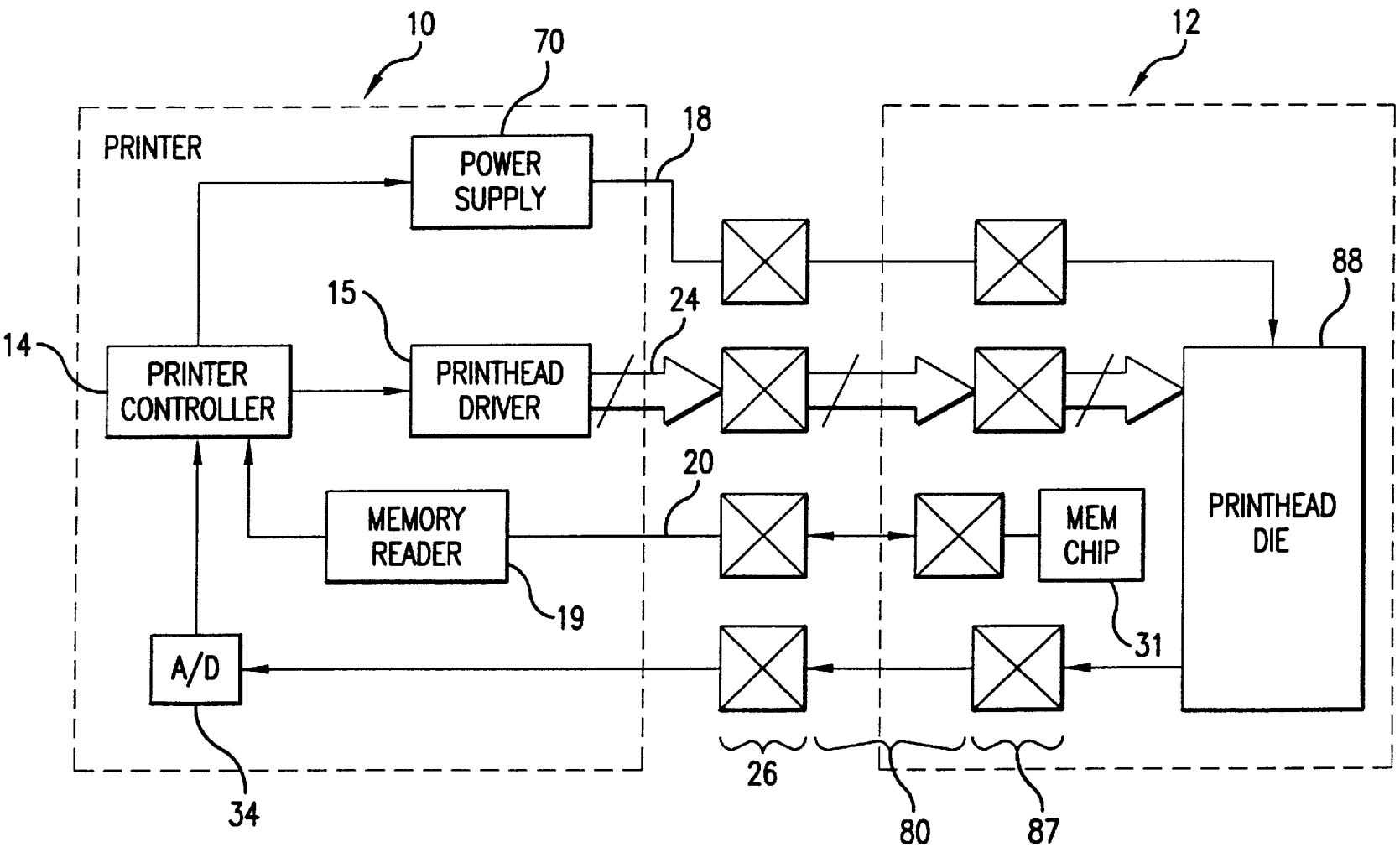
FIG. 4 is a schematic block diagram of a thermal inkjet printing apparatus in accordance with the invention.

FIG. 4 shows a schematic block diagram of an inkjet printer 10 with a connected print cartridge 12. A controller 14 in the printer 10 receives print data from a computer or microprocessor (not shown) and processes the data to provide printer control information or image data to a printhead driver circuit 15. A controlled voltage power supply 70 provides a controlled voltage to a power bus 18. A memory reader circuit 19 in the printer 10 is connected to the controller 14 for transmitting information received from the print cartridge 12 via a memory line 20. The printhead driver circuit 15 is controlled by the controller 14 to send the image data to a printhead substrate 88 on the print cartridge 12, via a control bus 24.

The cartridge 12 is removably replaceable and is electrically connected to the printer 10 by the control bus 24, power bus 18 and memory line 20. A connector interface 26 has a conductive pin for each line on the printer carriage side contacting a corresponding pad 86 on a flexible circuit tape 80 on the cartridge 12. A memory chip 31 on the cartridge stores printer control information programmed during manufacture of the cartridge and used by the printer during operation. The flex circuit 80 is connected to the printhead substrate 88 via bonds to electrodes 87. An analog-to-digital converter 34 in the printer is connected to the printhead to receive data from the printhead that indicates the printhead's temperature.

Figure 5:
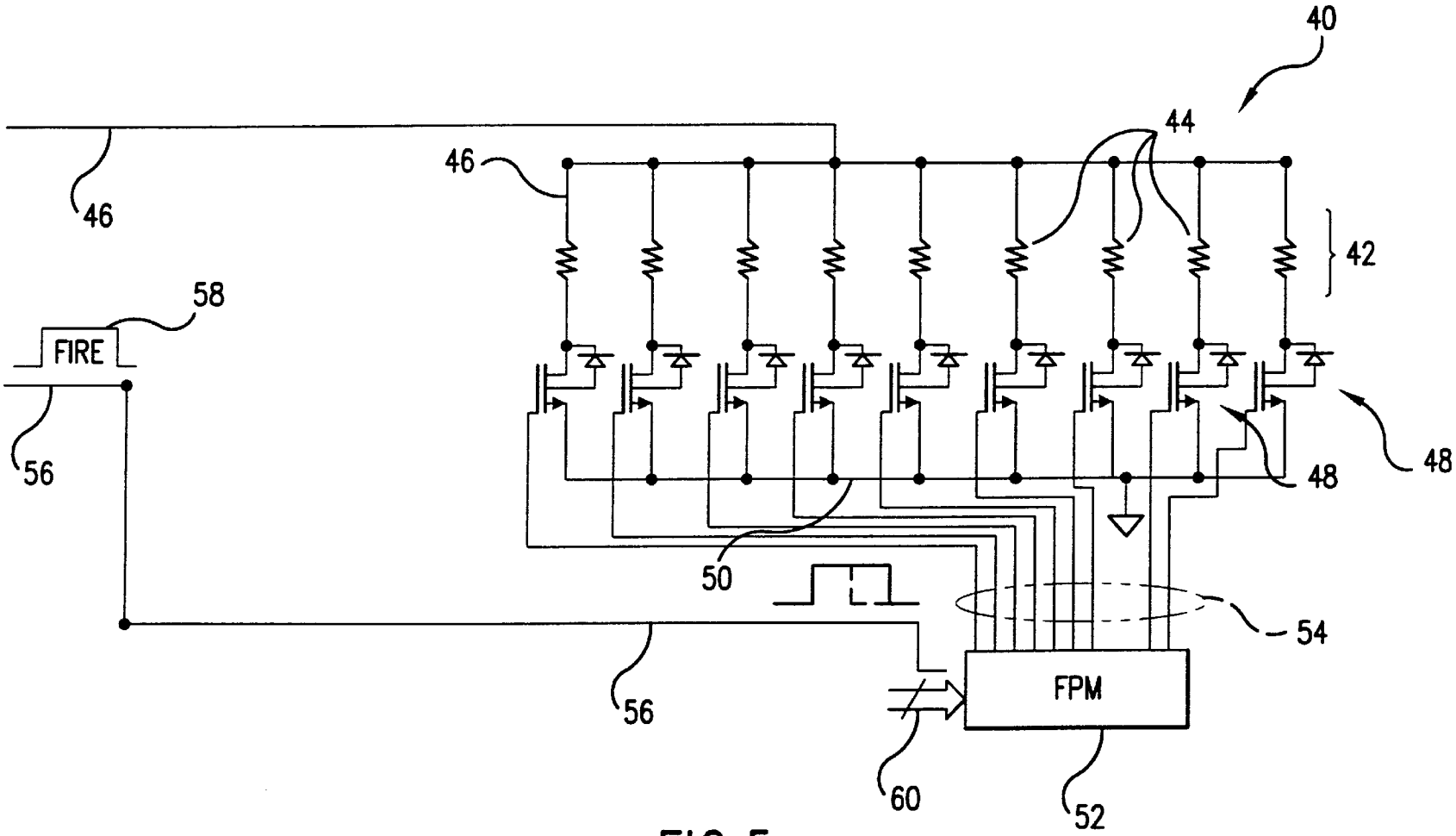
FIG. 5 is a detailed schematic of a printhead circuit of the embodiment of FIG. 4.

FIG. 5 shows a firing control circuit 40 and an exemplary fraction of the many ink ejection elements 44 on the printhead 22. Printhead 22 includes a substrate 88 having ink ejection elements 44, ink ejection chambers formed in a barrier layer 104 formed on the substrate and nozzles 82 formed in tape 80. The firing control circuit 40 resides on the printhead 22 substrate 88 and has a single pad to pad voltage input ("$V_{pp}$") 46 from the power bus 18 commonly connected to a set 42 of ink ejection elements 44. Each ink ejection element 44 is connected to a corresponding firing switch 48 connected to a ground line 50 and having a control input connected to the output 54 of a firing pulse modulator 52. The firing pulse modulator 52 receives print data on a bus 60 and outputs a firing signal on output lines 54 to each selected firing switch 48. To fire a selected group of the ink ejection element set 42, the printer sends an input voltage $V_{pp}$ on primitive line 46, and transmits a firing pulse 58 on address line 54. In response to the firing pulse, the firing pulse modulator 52 transmits the firing pulse 58 to the ink ejection element firing switches 48, causing the selected switches to close and connecting the ink ejection elements 44 to ground to allow current flow through the ink ejection elements 44 and thus generate firing energy.

The printhead assembly 22 has a large number of nozzles 82 with a firing ink ejection element 44 associated with each nozzle 82. In order to provide a printhead assembly where the ink ejection elements are individually addressable, but with a limited number of lines between the printer 10 and print cartridge 12, the interconnections to the ink ejection elements 44 in an integrated drive printhead are multiplexed. The print driver circuitry comprises an array of primitive lines 46, primitive commons 50, and address select lines 54 to control ink ejections elements 44. The printhead 22 may be arranged into any number of multiple similar subsections, such as quadrants, with each subsection being powered separately and having a particular number of primitives containing a particular number of ink ejection elements. Specifing an address line 54 and a primitive line 46 uniquely identifies one particular ink ejection element 44. The number of ink ejection elements within a primitive is equal to the number of address lines. Any combination of address lines and primitive select lines could be used, however, it is useflil to minimize the number of address lines in order to minimize the time required to cycle through the address lines.

Each ink ejection element is controlled by its own drive transistor 48, which shares its control input address select with the number of ejection elements 44 in a primitive. Each ink ejection element is tied to other ink ejection elements 44 by a common node primitive select. Consequently, firing a particular ink ejection element requires applying a control voltage at its address select terminal and an electrical power source at its primitive select terminal. In response to print commands from the printer, each primitive is selectively energized by powering the associated primitive select interconnection. To provide uniform energy per heater ink ejection element only one ink ejection element is energized at a time per primitive. However, any number of the primitive selects may be enabled concurrently. Each enabled primitive select thus delivers both power and one of the enable signals to the driver transistor. The other enable signal is an address signal provided by each address select line only one of which is active at a time. Each address select line is tied to all of the switching transistors 48 so that all such switching devices are conductive when the interconnection is enabled. Where a primitive select interconnection and an address select line for a ink ejection element are both active simultaneously, that particular heater ink ejection element is energized. Only one address select line is enabled at one time. This ensures that the primitive select and group return lines supply current to at most one ink ejection element at a time. Otherwise, the energy delivered to a heater ink ejection element would be a function of the number of ink ejection elements being energized at the same time.

Additional details regarding the control of inkjet printheads are described in U.S. patent application Ser. No. 09/016,478, filed Jan. 30, 1998, entitled "Hybrid Multi-Drop/Multi-Pass Printing System" now U.S. Pat. No. 6,193,347 and U.S. patent application Ser. No. 08/962,031, filed Oct. 31, 1997, entitled "Ink Delivery System for High Speed Printing" now U.S. Pat. No. 6,183,078 which are herein incorporated by reference.

In current printheads, an entire column of data is assembled in printer logic and the printer itself controls the sequence of energizing the printhead address and primitive lines which were demultiplexed. Moreover, current printheads have a dedicated connection to a primitive line, primitive ground and address line for each firing ink ejection element.

In new printheads having smart integrated logic on the printhead, data is transmitted to the printhead and the printhead decodes this data into address and primitive control signals. Data for all address lines must be sequentially sent to the printhead for each address line. In the time domain, this is one ejection period. In the physical location domain, this is called one column. These smart drive printheads have a large number of ink ejection elements making it difficult to have a direct connection for the address lines, primitive lines and primitive grounds. Accordingly, in smart drive printheads each firing ink ejection element may not have a dedicated connection. Without a dedicated connection there may be variations in delivered energy to a ink ejection element due to parasitic resistances. A set of ink ejection elements, or a primitive, is powered by a single voltage line that receives power via an electrical interconnection between the print cartridge electrical pads 86 and corresponding pads on the printer carriage 16. Power to the carriage 16 from the regulated voltage on the printer 10 is suppled by a flexible cable, or ribbon cable. The voltage line continues from the electrical contact pads 86 on a flexible electrical tape circuit 80 to a bonding connection to electrodes 87 on the printhead substrate 88. The printhead substrate 88 contains the firing ink ejection elements 44 and other control electronics, such as the drive transistors 48. The voltage line continues out from the printhead substrate 88 via a bonding connection to electrodes 87 on the printhead substrate 88 through the flexible electrical tape circuit 80 to print cartridge electrical pads. The voltage line continues to the carriage electrical interconnection between the print cartridge electrical pads 86 and to corresponding pads on the printer carriage 16. The voltage line continues from the carriage 16 to the voltage regulator via the flexible cable, or ribbon cable.

Figure 7:
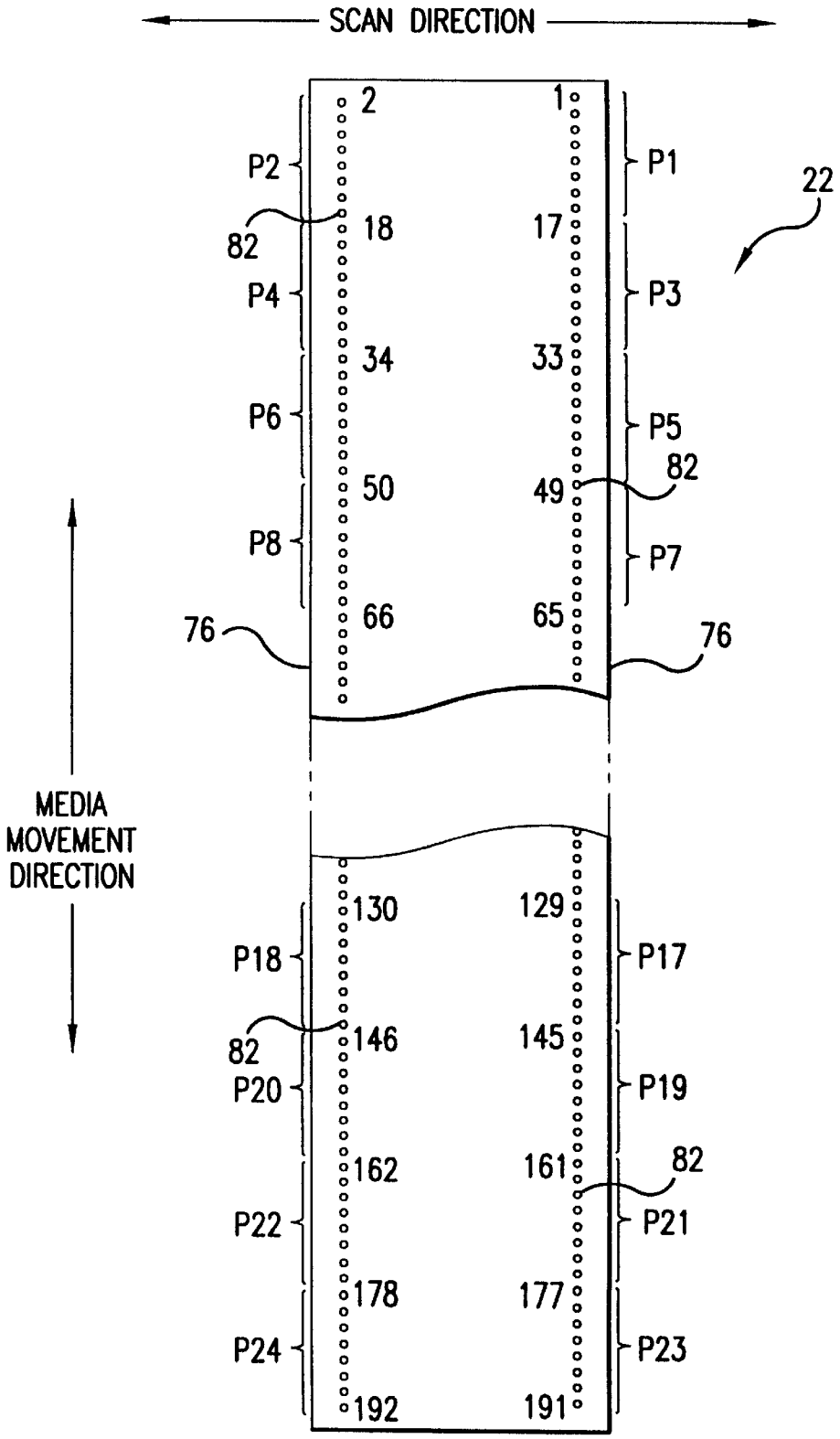
FIG. 7 is another view of one arrangement of nozzles and the associated ink ejection elements on the printhead of FIG. 6.

Referring to FIGS. 6 and 7, the orifices 82 and ink ejection elements 96 in printhead 22 are generally arranged in two major columns. The 192 orifices 82 and ink ejection elements 96 are also arranged in adjacent groupings of eight to form 24 primitives. Nozzles 82 are typically aligned in two vertical columns along printhead assembly 22, with the nozzles of a column in complete alignment with other nozzles of the same column. For purposes of clarity, the orifices 82 and ink ejection elements 44 are conventionally assigned a number as shown, starting at the top right as the printhead assembly as viewed from the bottom external surface of the printhead assembly 22 and ending in the lower left, thereby resulting in the odd numbers being arranged in one column and even numbers being arranged in the second column. Of course, other numbering conventions may be followed, but the description of the firing order of the orifices 82 and ink ejection elements 44 associated with this numbering system has advantages. One such advantage is that a row number is printed by the nozzle having the same nozzle number as the row number. The nozzles 82 in each column typically are spaced approximately 1/300 of an inch apart along the printhead assembly 22 and the nozzles of one column are offset from the nozzles of the other column by approximately 1/600 of an inch, thus providing 600 dpi printing.

Nozzles 82 and their associated ink ejection elements 44 and ink ejection chambers 102 of printhead 22 are organized into primitives (P1, P2, etc.), with each primitive having a primitive size defined by the number of nozzles or ink ejection elements in the primitive. Ink ejection elements 44 may be heater resistors or piezoelectric elements. As illustrated in FIG. 6, the printhead assembly 22 has twenty-four primitives of eight nozzles each, for a total of 192 nozzles. It should be noted that the number of primitives and the number of ink ejection elements in a primitive may be arbitrarily selected.

Since nozzles 82 are aligned in two vertical columns along printhead assembly 22, with the nozzles of each column being in complete alignment with other nozzles of the same column, the distance between a side edge 76 of printhead 22 and a nozzle 82 of a column is identical for every nozzle 82 in the column. Arrangement of nozzles 82 in two non-staggered coliuns is preferable to columns with staggered nozzles. The ink flow distance from side edge 76 of substrate 88 to an ink ejection chamber 102 is the same for each ink ejection chamber, eliminating any differences in the volume and velocity of ejected ink droplets and the speed at which the ink ejection chamber can be refilled.

Figure 8:
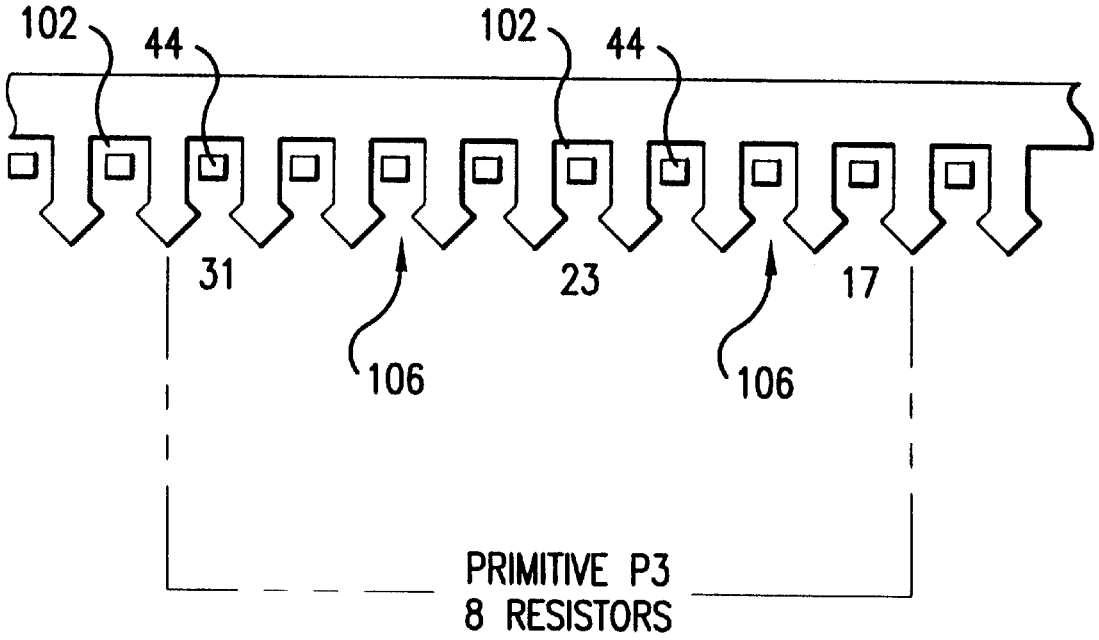
FIG. 8 is a top plan view of one primitive of the printhead, including ink ejection elements, ink ejection chambers, ink channels and barrier architecture.

FIG. 8 illustrates further details of primitive 3 shown in FIG. 6. Each nozzle 82 is aligned with a respective ink ejection element 44 formed on the substrate and with an ink ejection chamber 102 formed in the barrier layer 104. Also shown are ink channels 106 formed in the barrier layer. Ink channels 106 receive ink from an ink reservoir. Ink ejection elements 44 are coupled to electrical circuitry and are organized into groups of twenty-four primitives each of which contain eight ink ejection elements as discussed above.

Figure 9:
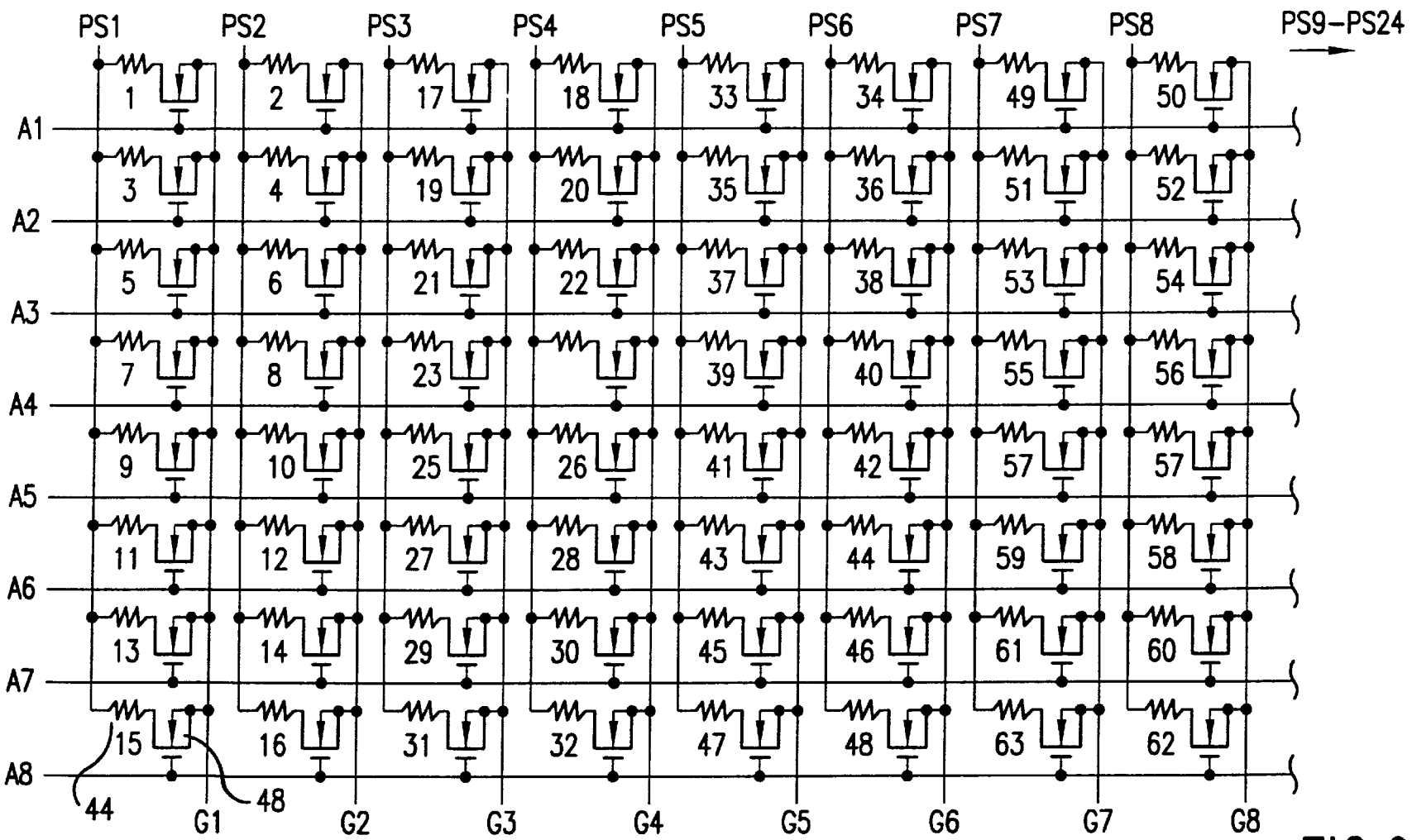
FIG. 9 is a schematic diagram of the address select lines and a representative portion of the associated ink ejection elements, primitive select lines and ground lines.

FIG. 9 is a schematic diagram of a representative portion of a printhead. The interconnections for controlling the printhead assembly driver circuitry include separate address select, primitive select and primitive common interconnections. The driver circuitry of this particular embodiment comprises an array of twenty-four primitive lines, twenty-four primitive commons and eight address select lines to control 192 ink ejections elements. Shown in FIG. 9 are all eight address lines, but only eight (PS1–PS8) of the twenty-four primitive select lines. The number of nozzles within a primitive is equal to the number of address lines, or eight, in this particular embodiment. Any other combination of address lines and primitive select lines could be used, however, it is important to minimize the number of address lines in order to minimize the time required to cycle through the address lines. Another embodiment uses an array of 11 address select lines, 28 primitive lines and 28 primitive commons to control 308 ink ejection elements.

FIGS. 10A–10C illustrate the correlation between nozzles/ink ejection elements 1–192 and their eight address select lines and twenty-four primitive select lines. Nozzles and associated ink ejection elements at the same relative position within their respective primitives have the same address select line. For example, ink ejection elements 1, 2; 17, 18; 33 and 34; etc., which are located at the first position within their respective primitives P1–P6, are associated with address select line A1. FIGS. 10A–10C make it easy to quickly determine which address line is used to print a particular row of dots and therefore change the address line firing order to minimize horizontal banding and vertical line jaggedness.

Figure 11:
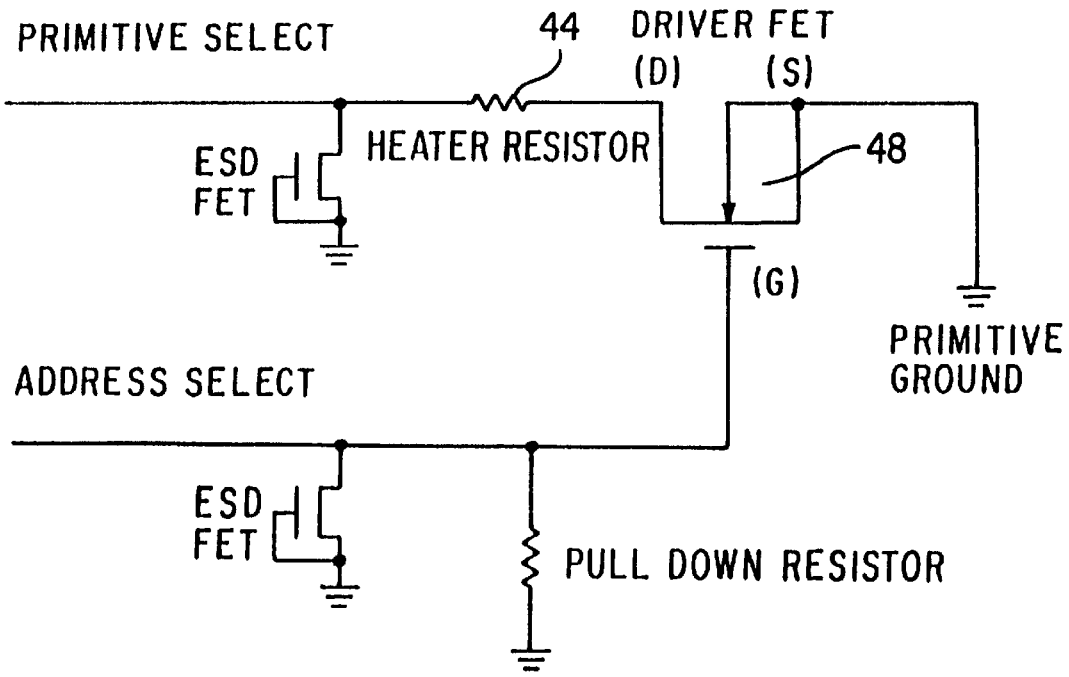
FIG. 11 is a schematic diagram of one ink ejection element of FIG. 9 and its associated address line, drive transistor, primitive select line and ground line.

FIG. 11 is a schematic diagram of an individual ink ejection element and its FET drive transistor. As shown, address select and primitive select lines also contain transistors for draining unwanted electrostatic discharge and a pull-down resistor to place all unselected addresses in an off state. Each ink ejection element is controlled by its own FET drive transistor 48, which shares its control input address select (A1–A8) with twenty-three other ink ejection elements 44. Each ink ejection element 44 is coupled to seven other ink ejection elements by a common node primitive select (PS1–PS24).

Firing a particular ink ejection element requires applying a control voltage at its address select terminal and an electrical power source at its primitive select terminal. The address select lines are sequentially turned on via printhead assembly interface circuitry to a firing order sequencer located on printhead 22, preferably located in firing pulse modulator 52. In the alternative, the firing order sequencer may be located in printer 10. Firing pulse modulator 52 is sequenced independently of the data 60 directing which ink ejection element is to be energized. The address lines are normally sequenced from A1 to A8 when printing from left to right and from A8 to A1 when printing from right to left. In accordance with the present invention the address line firing order is set so as to minimize horizontal banding and the jaggedness of vertical lines.

Figure 12:
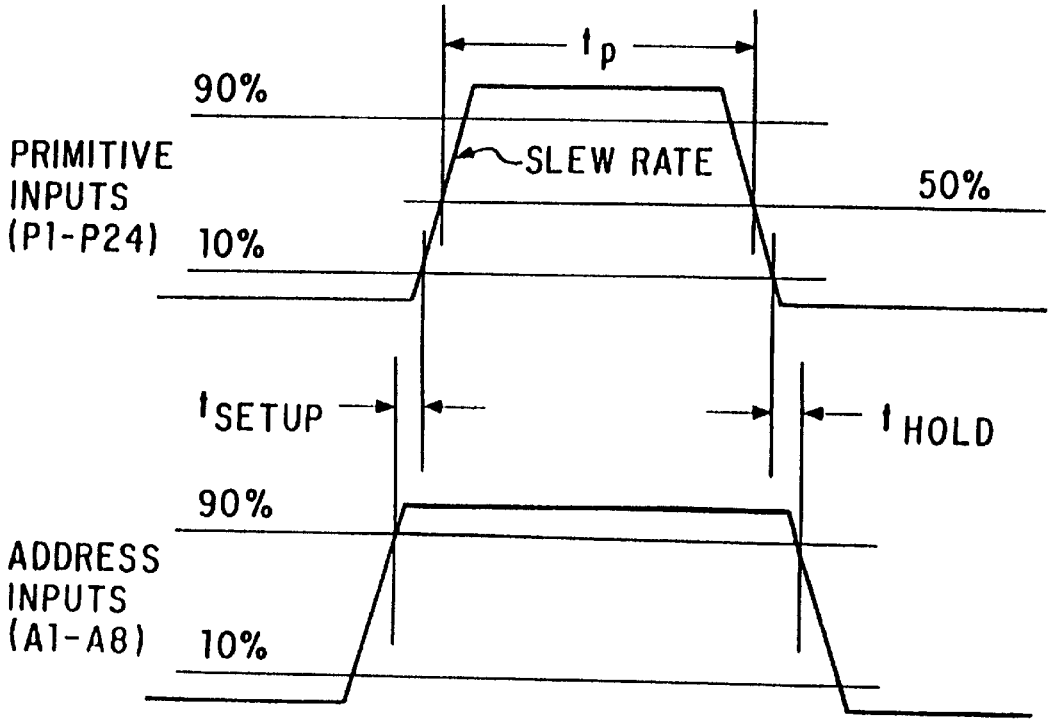
FIG. 12 is a schematic timing diagram for the setting of the address select and primitive select lines.

FIG. 12 is a schematic timing diagram for the setting of the address select and primitive select lines. The address select lines are sequentially turned on via printhead assembly interface circuitry according to the firing order sequencer. Primitive select lines (instead of address select lines) are used in the preferred embodiment to control the pulse width. Disabling address select lines while the drive transistors are conducting high current can cause avalanche breakdown and consequent physical damage to MOS transistors. Accordingly, the address select lines are "set" before power is applied to the primitive select lines, and conversely, power is turned off before the address select lines are changed as shown in FIG. 12.

In response to print commands from printhead 22 each primitive is selectively fired by powering the associated primitive select line interconnection. Only one ink ejection element 44 per primitive is energized at a time, however any number of primitive selects may be enabled concurrently. Each enabled primitive select delivers both power and one of the enable signals to the driver transistor 48. The other enable signal is an address signal provided by each address select line, only one of which is active at a time. Only one address select line is enabled at a time to ensure that the primitive select and group return lines supply current to at most one ink ejection element within a primitive at a time. Otherwise, the energy delivered to an ink-ejection element 44 would be a function of the number of elements being fired at the same time. Each address select line is tied to all of the switching transistors so that all such switching devices are conductive when the interconnection is enabled. Where a primitive select interconnection and an address select line for an ink ejection element 44 are both active simultaneously that particular element is energized.

Print cartridge 12 may cycle through its firing-order multiple times per pixel. In a preferred embodiment, print cartridge 12 proceeds through its firing order two or more times per pixel, thereby reducing any dot displacement error to a fraction of the dot displacement error that would occur if the print cartridge cycled through its firing order only once per pixel.

The ability to eject multiple individual ink drops at a high frequency is determined by the (1) minimum time to sequence through address lines, (2) ejection chamber refill time, (3) drop stability and (4) maximum data transmission rates between the printer and print cartridge. Designing the printhead with a small number of address lines is a key to high speed ink ejection by reducing the time it takes to complete the sequence through address lines. Since there are fewer nozzles within each primitive than on prior printhead designs, the ejection frequency of a single nozzle can be much higher. Also, the swath width can be programmed to use fewer nozzles and allow for even higher ejection rates. See U.S. patent application Ser. No. 09/016,478, filed Jan. 30, 1998, entitled "Hybrid Multi-Drop/Multi-Pass Printing System" now U.S. Pat. No. 6,193,347 which is herein incorporated by reference.

There are two frequencies associated with multi-drop printing. They are defined as a base frequency (F) and a burst frequency (f). The base frequency is established by the scanning carriage speed in inches per second multiplied by the resolution or pixel size in dots per inch. The base frequency is the ejection frequency required to eject one drop per pixel at the scanning carriage speed. The base period for a pixel is equal to 1/F. For example, for a carriage speed of 20 inches/sec and a resolution of 600 dots per inch (dpi) printing:

$$\text{Base Frequency}=F=(20\ \text{inches/sec})\times 600\ \text{dpi}=12{,}000\ \text{dots/sec}=12\ \text{kHz}$$

$$\text{Base Period}=1/F=1/12{,}000=83.33\ \text{microseconds}$$

The burst frequency, f, is always equal to or greater than the base frequency, F. The burst frequency is related to the maximum number of drops to be deposited on any single pixel in a single pass of the scanning carriage. The maximum number of drops that can be deposited on a pixel in one pass (see discussion of subcolumns below) is equal to the number of address lines. Thus, the burst frequency is equal to the base frequency multiplied by the maximum number of drops to be placed in a given pixel in a single pass. Therefore, for the base frequency of 12 kHz in the example above, if 4 drops are to be placed in a pixel, the burst frequency would need to be approximately 48 kHz and for 8 drops it would need to be approximately 96 kHz. If 96 kHz is too high a frequency for the ink ejection chamber to operate, the carriage speed could be reduced to 10 inches per second which reduces the base frequency to 6 kHz and the burst frequency for 8 drops to 48 kHz.

The approximate maximum burst frequency is determined from the following equation:

$$\text{maximum burst frequency} \simeq \frac{1}{(\text{No. of Addresses})(\text{Ejection Pulse Width} + \text{Delay})}$$

As the number of address lines decrease and ejection pulse width decreases, the maximum frequency increases. A minimum burst frequency of 50 kHz is guaranteed if there are eight address lines and ejection pulse widths less than 2.125 microseconds.

Figure 13:
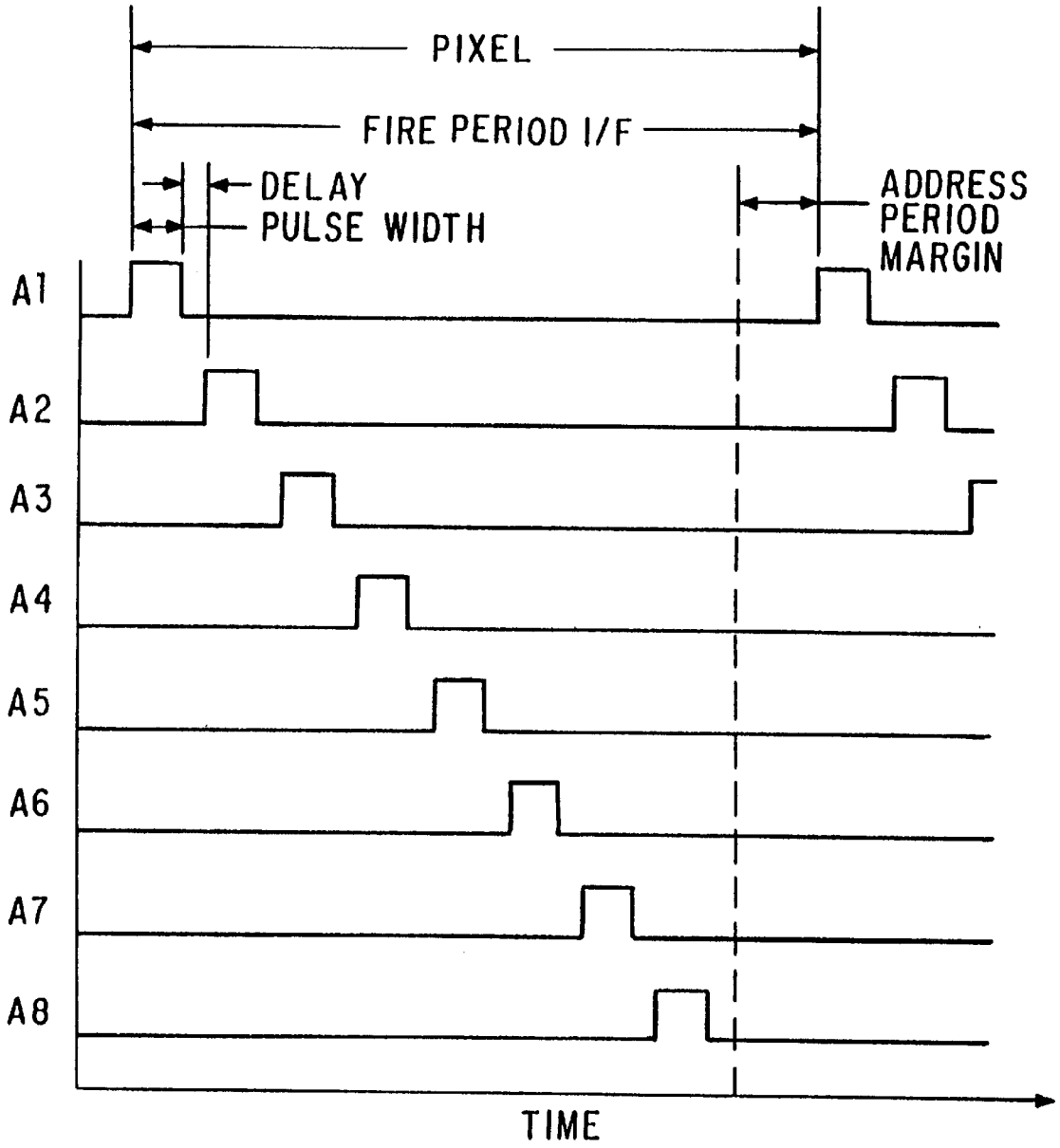
FIG. 13 is a schematic diagram of the firing sequence for the address select lines when the scanning carriage moves from left to right.

FIG. 13 shows the normal firing sequence when the print carriage is scanning from left to right. A base period is the total amount of time required to activate all of the address lines and to prepare to repeat the process. Each address period requires a pulse width time and a delay time which can include time to prepare to receive the data, and a variable amount of delay time applied to the data stream. The result of the number of address lines times the pulse width plus delay time generally consumes most of the total available base period. Any time left over is called the address period margin. The address period margin is to prevent address select cycles from overlapping by allowing for some amount of carriage velocity instability. The address period margin is set to a minimal acceptable value. The address period margin is usually approximately ten percent of the base period.

The base period (1/F) is determined by the scan velocity of the carriage and the base resolution or pixels per inch. The number of sub-columns, or sub-pixels, per pixel is defined by the total number of times the address lines are cycled though per pixel. This also determines the maximum number of drops which may be ejected on the each pixel. For example, a carriage scan speed of 20 inches/second means that for each 600 dpi pixel, the base period, 1/F is ($\frac{1}{20}$ inches/sec)×($\frac{1}{600}$ dots/inch)=83.33 microseconds. If there are four sub-columns, or sub-pixels, for each 600 dpi pixel, (i.e., the number of drops per 600 dpi pixel), a total of (83.33 microseconds)/(4 ejection periods)=20.83 microseconds are available for each burst period. Dividing this time by the number of address lines (20.83 microseconds)/(8 address lines)=2.60 seconds/address line gives the maximum time available for each of the address lines. The total of the pulse width and delay times must be less than this time period.

Figure 14:
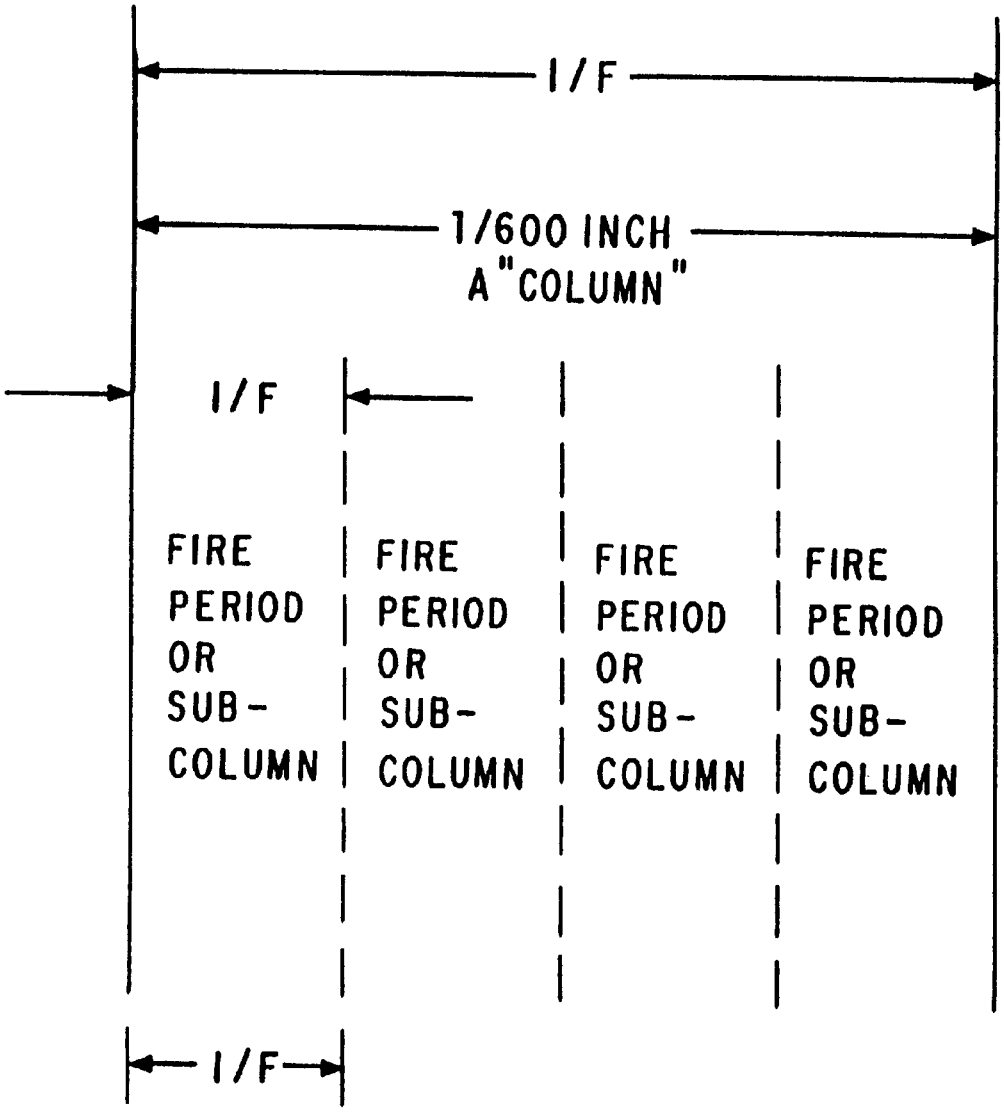
FIG. 14 shows the relationship between subcolumns and burst frequency for a printhead cycling through the address lines four times per pixel.

FIG. 14, illustrates the sub-columns for four drops per column or pixel which corresponds to a virtual resolutions of 2400 dpi or to a burst frequency of 48 kHz for a carriage speed of 20 inches per second. For four drops/column the eight address lines are cycled through four times, respectively. Other numbers of sub-columns, or sub-pixels, and the corresponding virtual resolutions are also possible such as: 1 drop/column (600 dpi), 2 drops/column (1200 dpi), 8 drops/column (4800 dpi) and where a column refers to a 600 dpi pixel. The virtual resolutions of 1200, 2400 and 4800 dpi correspond to burst frequencies of 24, 48 and 96 kHz, respectively, for a base frequency of 12 kHz. If the carriage scan velocity is reduced, the base frequency and burst frequency are reduced accordingly. Thus, the virtual resolution of the printer is determined by the number of drops ejected in each 600 dpi pixel in physical space or within the base time period (1/F) in temporal space.

A printer in accordance with the present invention operates as follows. Scanning carriage 14 with print cartridge 12 mounted thereon moves along slide rod 17 in a first direction, such as from left to right. As scanning carriage 14 moves toward the right, energization signals are applied to print cartridge 12 and ink ejection elements and nozzles 82 deposit ink onto media. Scanning carriage 14 then moves along slide rod 17 in the opposite direction, from right to left, to its original position to begin a second scan. Alternatively, scanning carriage 16 moves along slide rod 17 in the opposite direction, from right to left, and print cartridge 12 deposits a second portion of ink on media. Once scanning carriage 16 reaches the right side of slide rod 17, the media is either advanced or not advanced through print zone 13 by a particular number of rows which is dependent on the printmode being used. This process is repeated until the entire portion of ink has been deposited on media.

The present invention picks a firing orders for the ink ejection elements which minimize the print quality effect of dot positional errors with non-staggered print carridges using multiple drop bursts per pixel. The printhead is a high firing frequency, multiple address line cycles per pixel, designed with no ink ejection element stagger and no rotation of the printhead. This has the advantage of having the fluidic responses of the firing chambers all the same, which results in faster print cartridges with less overshoot and puddling. High speed, multi-dropping pens can be designed with no resistor stagger because the total positional error produced is small, i.e., a fraction of a column or pixel width. However, even these small positional errors are visible when they are repeated in a regular pattern.

The present invention will be described in terms of the printhead 12 and printer 10 described above. The printhead is normally designed to fire the ink ejection elements 44 in each primitive sequentially. Accordingly, ink ejection elements 1 and 2 in primitives 1 and 2, respectively, fire at the same time as ink ejection elements 17 and 18 in primitives 3 and 4, respectively, and likewise for the first ink ejection element all the other primitives. Then ink ejection elements 3, 4 fire at the same time as ink ejection elements 19, 20, and so on sequentially through the primitives.

The error in each odd/even dot pair is then:

$$\text{Drop Displacement Error}=[1/\text{DPI}]*[1/\text{DBP}]*[(AL_n-1)/AL_{total}]$$

where $AL_n$=the address line number $AL_{total}$=the total number of address lines DPI=the dots per inch resolution if the printhead DBP=the number of drop bursts per pixel The above equation assumes that address line one is the base point and therefore has no error.

Thus, for a 600 DPI print cartridge with 8 address lines, firing 4 drop bursts per pixel the error is $[\frac{1}{2400}]*[(AL_n-1)/8]$. For the same print cartridge firing 2 drop bursts per pixel the error is $[\frac{1}{1200}]*[(AL_n-1)/8]$. The dot placement error is caused by the carriage velocity and the fact that the address lines are fired at different times. Each of the eight address lines of the print cartridge has a characteristic dot displacement error, which increases from address line 1 to address line 8 assuming address line 1 as the base point. The present invention reduces the relative dot placement error between rows by selecting a firing order which minimizes the dot placement error as calculated by the above equation by avoiding having adjacent rows printed address lines having a large difference between them, i.e., address lines one and eight. TABLE I shows the dot placement error for the eight address lines based on the above equation.

TABLE I

| Address Line | Dot Displacement Error |
|---|---|
| 1 | 0 |
| 2 | [1/DPI] * [1 / DBP] * 1/8 |
| 3 | [1/DPI] * [1 / DBP] * 1/4 |
| 4 | [1/DPI] * [1 / DBP] * 3/8 |
| 5 | [1/DPI] * [1 / DBP] * 1/2 |
| 6 | [1/DPI] * [1 / DBP] * 5/8 |
| 7 | [1/DPI] * [1 / DBP] * 3/4 |
| 8 | [1/DPI] * [1 / DBP] * 7/8 |

Accordingly, the smallest relative dot placement error is obtained by minimizing the difference between address lines printing adjacent rows.

Figure 15:
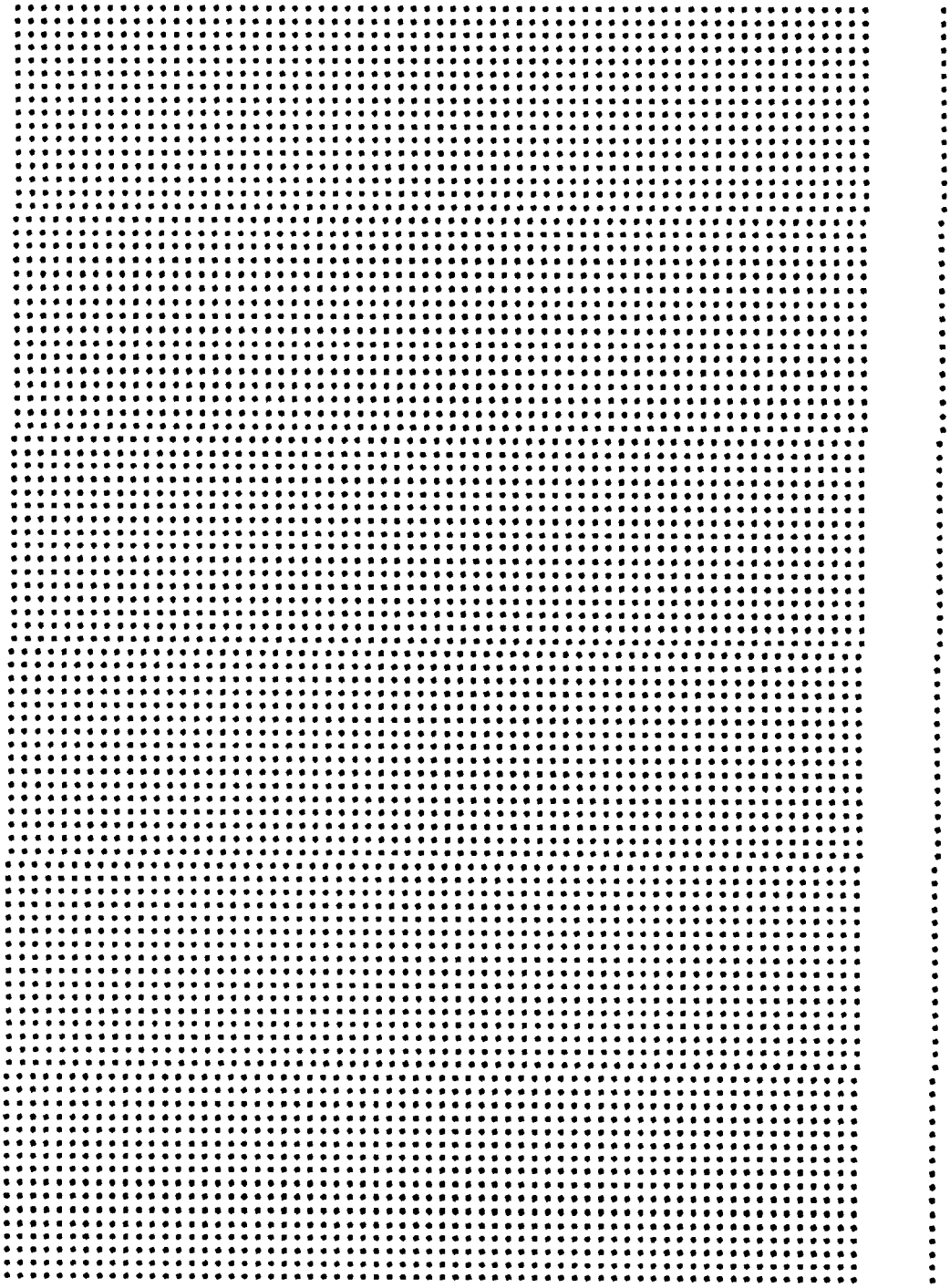
FIG. 15 illustrates vertical line jaggedness and horizontal banding produced by an inkjet printer not using the present invention.

FIG. 15 illustrates the problem of horizontal banding and the jaggedness of vertical lines. Here, a swath of ink has been deposited by a 600 dpi printer in a one-pass printing operation. The print cartridge of this printer, which cycles through its firing order four times per pixel, has non-staggered nozzles, a primitive size of eight ink ejection elements and a total of twenty-four primitives. Thus, a primitive boundary occurs every 16 rows. Referring to FIGS. 10A–10C, row 16 is printed with address line 8 and adjacent row 17 is printed with address line 1. Thus, using TABLE I row 17 is offset horizontally from row 16 by (1/2400)*7/8 inches. The result is a visible jaggedness in vertical lines and the appearance of horizontal lines in the solid area.

The single column at the right is to more clearly illustrate the jaggedness of the column without the interference of the other lines.

The firing order used to produce FIG. 15 wherein the ink ejection elements are fired sequentially in numerical order within each primitive can be represented as follows:

TABLE II

| | \|< -- PRIMITIVE 1 -- > | | | | | | | | \| <----- PRIMITIVE 2 ------> | | | | | | | | \| --- > |
|---|---|---|---|---|---|---|---|---|---|---|---|---|---|---|---|---|---|
| Ink ejection element | 1 | 3 | 5 | 7 | 9 | 11 | 13 | 15 | \| | 17 | 19 | 21 | 23 | 25 | 27 | 29 | 31 |
| Firing Order | 1 | 2 | 3 | 4 | 5 | 6 | 7 | 8 | \| | 1 | 2 | 3 | 4 | 5 | 6 | 7 | 8 |

Thus, the firing order of the resistors is 1 3 5 7 9 11 13 15 and 17 19 21 23 25 27 29 31.

The goal of the present invention is to minimize the dot placement errors between adjacent rows and be much less than the 1/2400*7/8 error shown above in FIG. 15. This alternate firing order of the present invention is shown in TABLE III below.

TABLE III

| | \|< ---- PRIMITIVE 1 -----> | | | | | | | | \| <----- PRIMITIVE 2 ------> | | | | | | | | \|P3 |
|---|---|---|---|---|---|---|---|---|---|---|---|---|---|---|---|---|---|
| Ink ejection element | 1 | 3 | 5 | 7 | 9 | 11 | 13 | 15 | \| | 17 | 19 | 21 | 23 | 25 | 27 | 29 | 31 |
| Firing Order of Address Lines | 1 | 3 | 5 | 7 | 8 | 6 | 4 | 2 | \| | 1 | 3 | 5 | 7 | 8 | 6 | 4 | 2 |

Represented another way, the firing order of the address lines is such that the resistors fire in the order 1, 15, 3, 13, 5, 11, 7, 9 and 17, 31, 19, 29, 21, 27, 23, 25.

Figure 16:
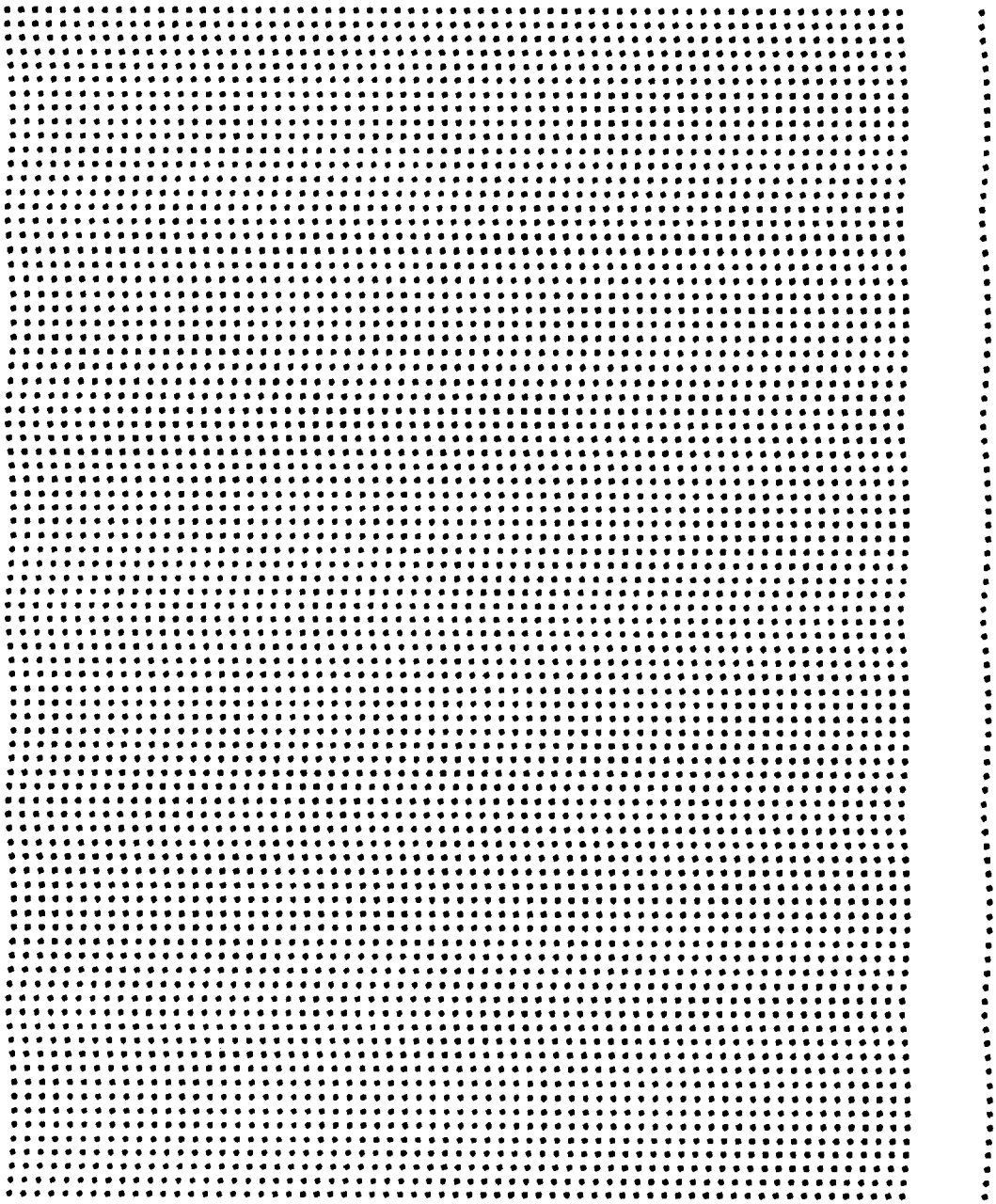
FIG. 16 illustrates the reduced vertical line jaggedness and horizontal banding produced by an inkjet printer in accordance with the present invention.

FIG. 16 shows the results of the alternate firing order of TABLE III. The maximum error now is only [1/2400]*[2/8] and the horizontal banding is greatly reduced. Whereas in FIG. 15 the horizontal bands at the primitive boundaries are clearly seen as a repetitive pattern, this not the case in FIG. 16. Also, the vertical lines do not have a step displacements, but are merely "wavy" instead.

Still another firing order in accordance of the present invention is shown in TABLE IV. It also seeks to reduce the horizontal bands and eliminate the step in vertical lines while keeping line jaggedness at a minum.

TABLE IV

| | \|< ------ PRIMITIVE 1 ----- > | | | | | | | | \| <----- PRIMITIVE 2 ----- > | | | | | | | | \| --> |
|---|---|---|---|---|---|---|---|---|---|---|---|---|---|---|---|---|---|
| Ink ejection element | 1 | 3 | 5 | 7 | 9 | 11 | 13 | 15 | \| | 17 | 19 | 21 | 23 | 25 | 27 | 29 | 31 |
| Firing Order | 1 | 4 | 8 | 6 | 3 | 7 | 5 | 2 | \| | 1 | 4 | 8 | 6 | 3 | 7 | 5 | 2 |

Represented another way, the firing order of the address lines is such that the resistors fire in the order 1, 15, 9, 3, 13, 7, 11, 5 and 17, 31, 25, 19, 29, 23, 27, 21.

Figure 17:
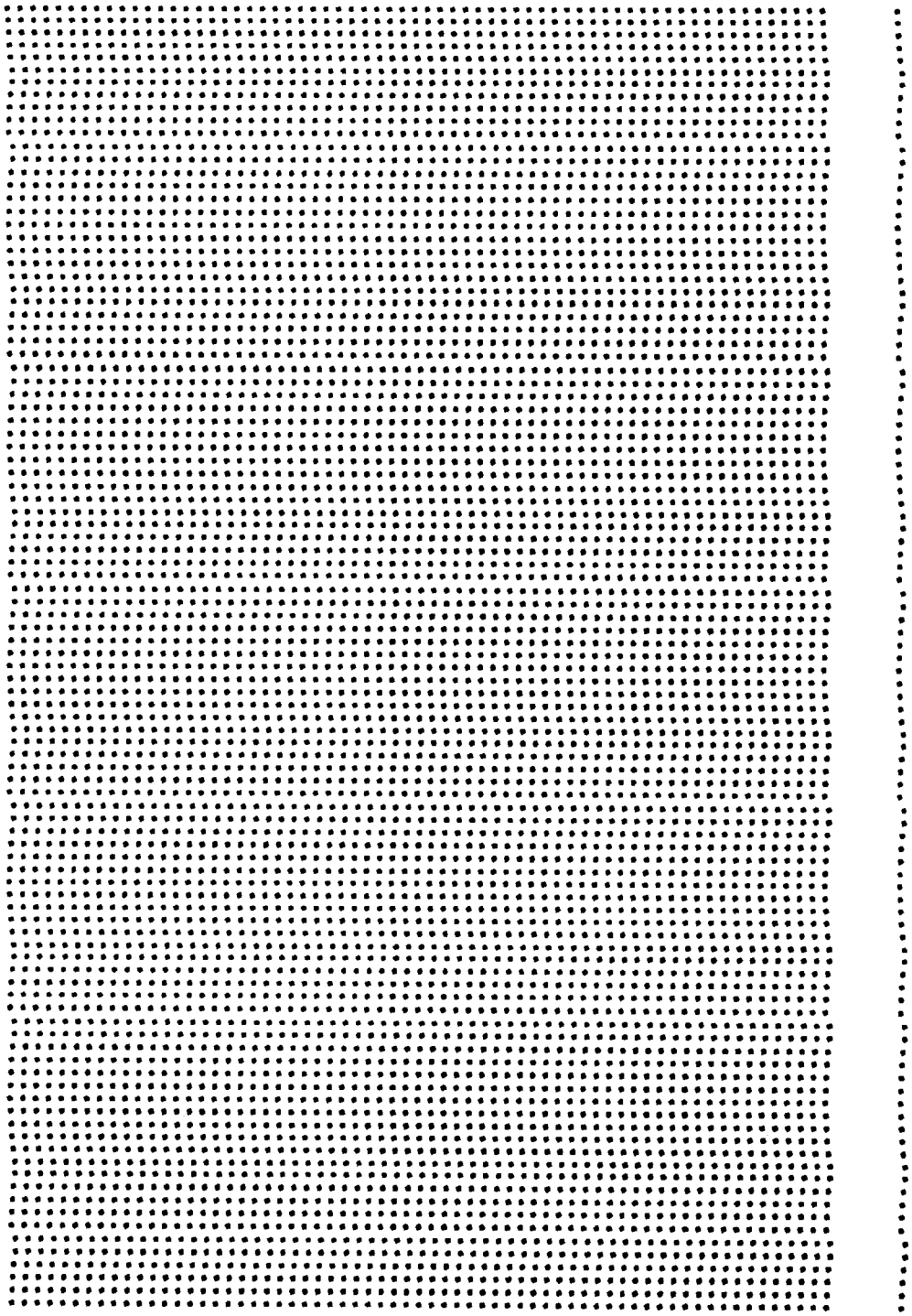
FIG. 17 illustrates the reduced vertical line jaggedness and horizontal banding produced by an inkjet printer in accordance with the present invention.

FIG. 17 shows the results of the alternate firing order shown in TABLE IV. The horizontal banding is again greatly reduced and vertical lines do not have a step displacements, but are again slightly wavy. Moreover, the amplitude of the "waves" is decreased and the frequency of the waves is increased, or stated another way the wave length of the waves is reduced from those of FG. 16.

One skilled in the art will readily realize that there are various ways to minimize the relative dot placement errors by changing the firing order. The order could be calculated using standard error minimizing techniques. Alternatively, a purely randomnization of the firing order could be used. While complete randomization would again introduce some instances where the dot placement error is large, randomization would remove dot placement errors occurring repetitively at primitive boundaries.

Figure 18:
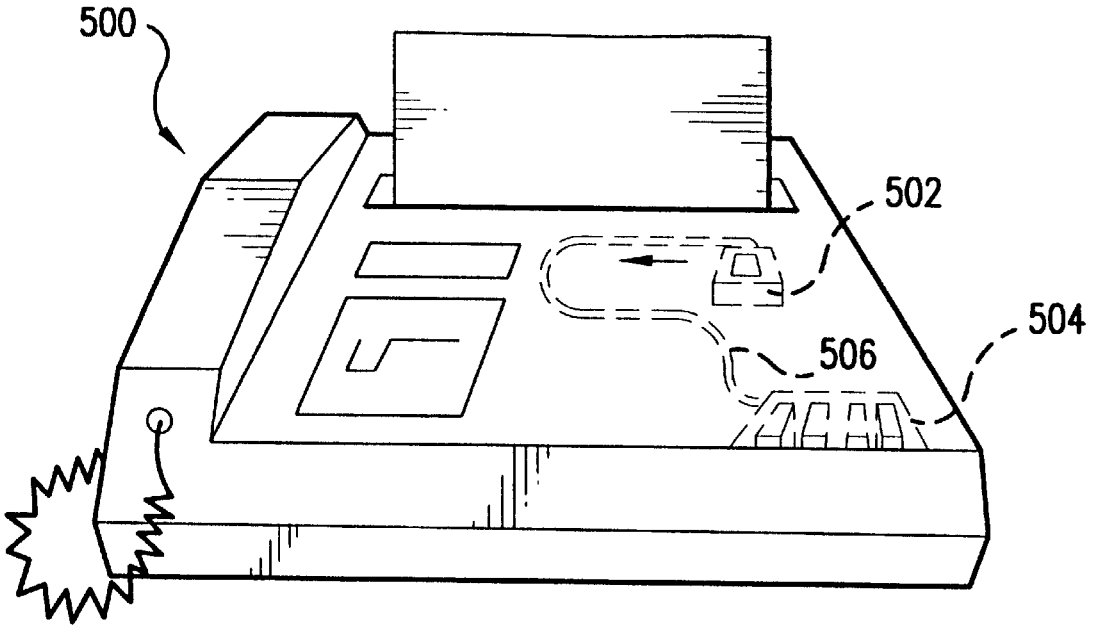
FIG. 18 is a perspective view of a facsimile machine showing one embodiment of the ink delivery system in phantom outline.

The present invention allows a wide range of product implementations other than that illustrated in FIG. 1. For example, such ink delivery systems may be incorporated into an inkjet printer used in a facsimile machine 500 as shown in FIG. 18, where a scanning cartridge 502 and an off-axis ink delivery system 504, connected via tube 506, are shown in phantom outline.

Figure 19:
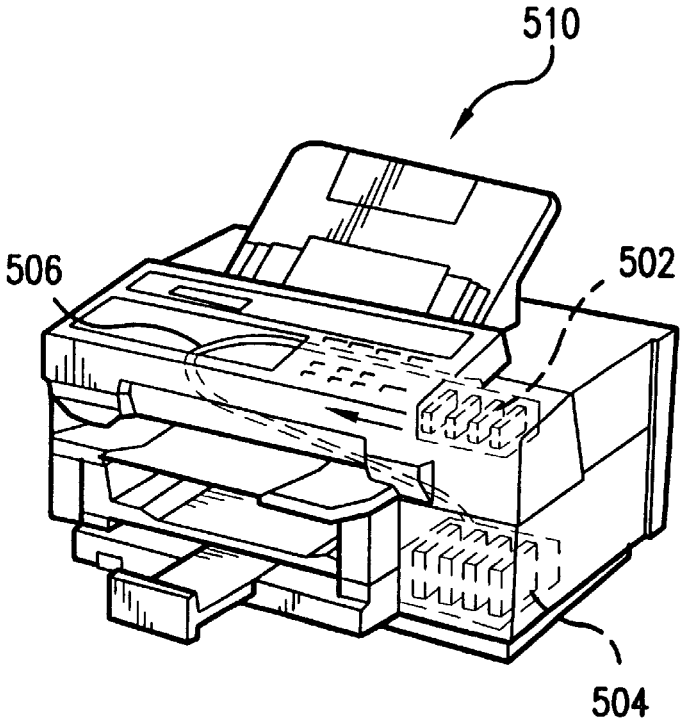
FIG. 19 is a perspective view of a copier which may be a combined facsimile machine and printer, illustrating one embodiment of the ink delivery system in phantom outline.

FIG. 19 illustrates a copying machine 510, which may also be a combined facsimile/copying machine, incorporating an ink delivery system described herein. Scanning print cartridges 502 and an off-axis ink supply 504, connected via tube 506, are shown in phantom outline.

Figure 20:
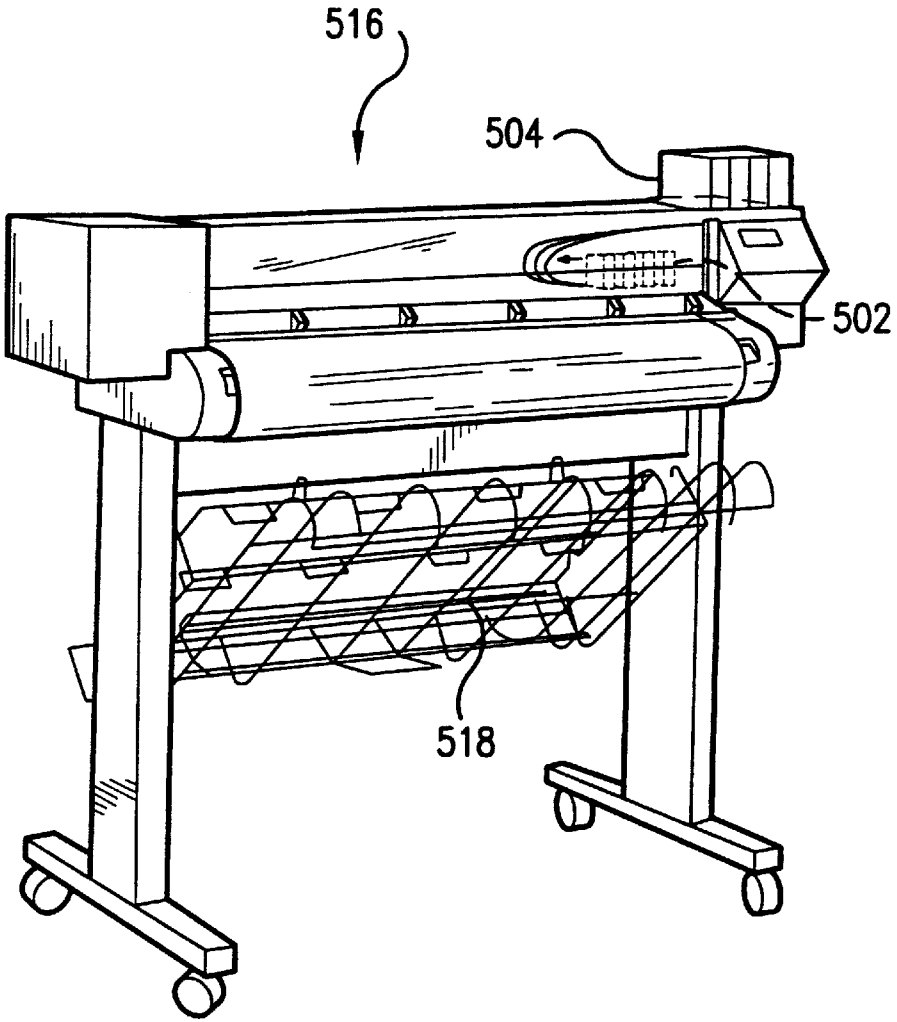
FIG. 20 is a perspective view of a large-format inkjet printer illustrating one embodiment of the ink delivery system.

FIG. 20 illustrates a large-format printer 516 which prints on a wide, continuous media roll supported by tray 518. Scanning print cartridges 502 are shown connected to the off-axis ink supply 504 via tube 506.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A printer for printing rows and columns of ink dots onto a medium, the printer comprising:

a scanning carriage for scanning across the medium;

a printhead mounted on the scanning carriage, the printhead including a plurality of primitives, each primitive having a plurality of ink ejection elements for ejecting ink therefrom, said primitive having a primitive size defined by the number of ink ejection elements within the primitive;

a primitive select circuit electrically coupled to the ink ejection elements of the primitives and including a plurality of primitive lines for energizing the ink ejection elements;

an address select circuit electrically coupled to the ink ejection elements of the primitives and including a plurality of address lines for addressing the ink ejection elements, so that ink ejection elements located at a particular physical position within their respective primitives have the same address line; and an address line sequencer for setting a firing order in which the address lines are energized in a non-sequential firing order that reduces horizontal banding and vertical jaggedness.

2. The printer of claim 1 wherein the address line sequencer sets the firing order such that dot displacement error as measured by $$[1/DPI]*[1/DBP]*[(AL_n-1)/AL_{total}]$$

where $AL_n$ is the address line number, $AL_{total}$ is the total number of address lines, DPI is the dots per inch resolution of the printhead and DBP is the number of drop bursts per pixel, is minimized.

3. The printer of claim 2 wherein the address line sequencer sets the firing order such that dot displacement error is minimized at the boundary of a first primitive and an adjacent second primitive.

4. The printer of claim 1 wherein the address line sequencer sets the firing order by alternating between address lines representing ink ejection elements physically located at a first end of the primitive and the distal second end of the primitive.

5. The printer of claim 1 wherein the address line sequencer sets the firing order in a random order.

6. The printer of claim 1 wherein the address line sequencer sets the firing order such that the last row of a first primitive and the first row of an adjacent second primitive are printed with the same address line.

7. The printer of claim 1 wherein the address line sequencer sets the firing order such that the last row of a first primitive and the first row of an adjacent second primitive are printed with adjacent address lines.

8. The printer of claim 1 wherein the address line sequencer sets the firing order such that the last row of a first primitive and the first row of an adjacent second primitive are printed with the closest available address lines.

9. The printer of claim 1 wherein the ink ejection elements of the printhead are aligned in one or more non-staggered columns along the length of the printhead.

10. The printer of claim 1 wherein the address line sequencer cycles through the address lines two or more times per column.

11. A method of printing rows and columns of ink dots onto a medium, the method comprising:

scanning a printhead across the medium, the printhead including a plurality of primitives, each primitive having a plurality of ink ejection elements for ejecting ink therefrom, said primitive having a primitive size defined by the number of ink ejection elements within the primitive;

a primitive select circuit electrically coupled to the ink ejection elements of the primitives and including a plurality of primitive lines for energizing the ink ejection elements; and an address select circuit electrically coupled to the ink ejection elements of the primitives and including a plurality of address lines for addressing the ink ejection elements, so that ink ejection elements located at a particular physical position within their respective primitives have the same address line;

sequencing the address lines in a non-sequential firing order that reduces horizontal banding and vertical jaggedness.

12. The method of claim 11 wherein the address line sequencing sets the firing order such that dot displacement error as measured by $$[1/DPI]*[1/DBP]*[(AL_n-1)/AL_{total}]$$

where $AL_n$ is the address line number, $AL_{total}$ is the total number of address lines, DPI is the dots per inch resolution of the printhead and DBP is the number of drop bursts per pixel, is minimized.

13. The method of claim 12 wherein the address line sequencing sets the firing order such that dot displacement error is mininmized at the boundary of a first primitive and an adjacent second primitive.

14. The method of claim 11 wherein the address line sequencing sets the firing order by alternating between address lines representing ink ejection elements physically located at a first end of the primitive and the distal second end of the primitive.

15. The method of claim 11 wherein the address line sequencing sets the firing order in a random order.

16. The method of claim 11 wherein the address line sequencing sets the firing order such that the last row of a first primitive and the first row of an adjacent second primitive are printed with the same address line.

17. The method of claim 11 wherein the address line sequencing sets the firing order such that the last row of a first primitive and the first row of an adjacent second primitive are printed with adjacent address lines.

18. The method of claim 11 wherein the address line sequencing sets the firing order such that the last row of a first primitive and the first row of an adjacent second primitive are printed with the closest available address lines.

19. The method of claim 11 wherein the ink ejection elements of the printhead are aligned in one or more non-staggered columns along the length of the printhead.

20. The method of claim 11 wherein the sequencing through the address lines occurs two or more times per column.

* * * * *